US010618304B2

(12) United States Patent
Ichinowatari

(10) Patent No.: US 10,618,304 B2
(45) Date of Patent: Apr. 14, 2020

(54) LIQUID DISCHARGE DEVICE AND LIQUID DISCHARGE APPARATUS

(71) Applicant: Jun Ichinowatari, Kanagawa (JP)

(72) Inventor: Jun Ichinowatari, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/210,002

(22) Filed: Dec. 5, 2018

(65) Prior Publication Data

US 2019/0255856 A1 Aug. 22, 2019

(30) Foreign Application Priority Data

Feb. 19, 2018 (JP) ..... 2018-027241
Sep. 21, 2018 (JP) ..... 2018-177161

(51) Int. Cl.

| | |
|---|---|
| ***B41J 2/175*** | (2006.01) |
| ***B41J 2/14*** | (2006.01) |
| ***B41J 2/19*** | (2006.01) |
| ***B41J 2/045*** | (2006.01) |
| ***B41J 29/38*** | (2006.01) |

(52) U.S. Cl.

CPC ..... *B41J 2/17596* (2013.01); *B41J 2/04541* (2013.01); *B41J 2/14233* (2013.01); *B41J 2/19* (2013.01); *B41J 29/38* (2013.01); *B41J 2/04581* (2013.01); *B41J 2/17503* (2013.01); *B41J 2002/14266* (2013.01)

(58) Field of Classification Search

CPC ..... B41J 2/04541; B41J 2/04581; B41J 2/14016; B41J 2/14233; B41J 2/175; B41J 2/17503; B41J 2/17596; B41J 2/18; B41J 2/185; B41J 2/19; B41J 29/38; B41J 2002/14266; B41J 2202/12

See application file for complete search history.

(56) References Cited

U.S. PATENT DOCUMENTS 5,818,485 A * 10/1998 Rezanka ..... B41J 2/18 347/89
6,152,559 A * 11/2000 Kojima ..... B41J 2/175 347/89

(Continued)

FOREIGN PATENT DOCUMENTS

JP 2011-005782 1/2011

OTHER PUBLICATIONS

Extended European Search Report dated Jun. 14, 2019 in Patent Application No. 18212192.1, 7 pages.

*Primary Examiner* — Anh T Vo
(74) *Attorney, Agent, or Firm* — Oblon, McClelland, Maier & Neustadt, L.L.P.

(57) ABSTRACT

A liquid discharge device includes a liquid discharge head to discharge a liquid, a liquid storage portion to store the liquid, a first channel to discharge the liquid from the liquid storage portion via the liquid discharge head, and a second channel to connect a top portion of the liquid storage portion and the first channel, a fluid resistance of the first channel is less than a fluid resistance of the second channel. The first channel extends from a junction between the liquid storage portion and the first channel to a junction between the first channel and the second channel. The second channel extends from a junction between the liquid storage portion and the second channel to the junction between the first channel and the second channel.

13 Claims, 16 Drawing Sheets

(56) References Cited

U.S. PATENT DOCUMENTS

| | | | | |
|---|---|---|---|---|
| 2008/0158304 | A1* | 7/2008 | Eto | B41J 2/1404 347/65 |
| 2010/0289856 | A1* | 11/2010 | Yamamoto | B41J 2/17509 347/85 |
| 2010/0328408 | A1 | 12/2010 | Akiyama et al. | |
| 2011/0050816 | A1 | 3/2011 | Katoh et al. | |
| 2011/0096129 | A1 | 4/2011 | Nishimori | |
| 2011/0128334 | A1 | 6/2011 | Akiyama et al. | |
| 2011/0128335 | A1* | 6/2011 | von Essen | B41J 2/14 347/89 |
| 2011/0134184 | A1 | 6/2011 | Katoh et al. | |
| 2011/0141167 | A1 | 6/2011 | Kikkawa et al. | |
| 2012/0062659 | A1 | 3/2012 | Tsubaki | |
| 2013/0187985 | A1 | 7/2013 | Katoh et al. | |
| 2014/0132663 | A1 | 5/2014 | Ichinowatari | |

* cited by examiner

LIQUID DISCHARGE DEVICE AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-027241, filed on Feb. 19, 2018, and Japanese Patent Application No. 2018-177161, filed on Sep. 21, 2018, in the Japan Patent Office, the entire disclosure of each of which is hereby incorporated by reference herein.

BACKGROUND

Technical Field

Aspects of the present disclosure relate to a liquid discharge device and a liquid discharge apparatus.

Related Art

A liquid discharge device is known that includes a liquid discharge head, a liquid container, and a communication channel for discharging a liquid from the liquid container without the liquid passing through the liquid discharge head for discharging bubbles. A fluid resistance in the communication channel is greater than a fluid resistance from a supply port to a discharge port of the liquid discharge head.

SUMMARY

In an aspect of this disclosure, a novel liquid discharge device includes a liquid discharge head to discharge a liquid, a liquid storage portion to store the liquid, a first channel to discharge the liquid from the liquid storage portion via the liquid discharge head, and a second channel to connect a top portion of the liquid storage portion and the first channel. A fluid resistance of the first channel is less than a fluid resistance of the second channel. The first channel extends from a junction between the liquid storage portion and the first channel to a junction between the first channel and the second channel. The second channel extends from a junction between the liquid storage portion and the second channel to the junction between the first channel and the second channel.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1B:
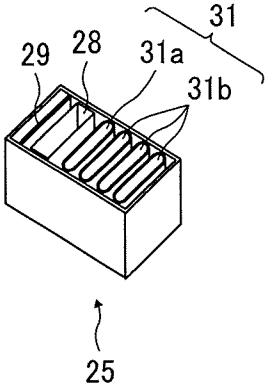
FIGS. 1A and 1B are perspective views of an image forming apparatus according to the embodiments.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Embodiments of the present disclosure are described below with reference to the attached drawings.

Figure 1A:
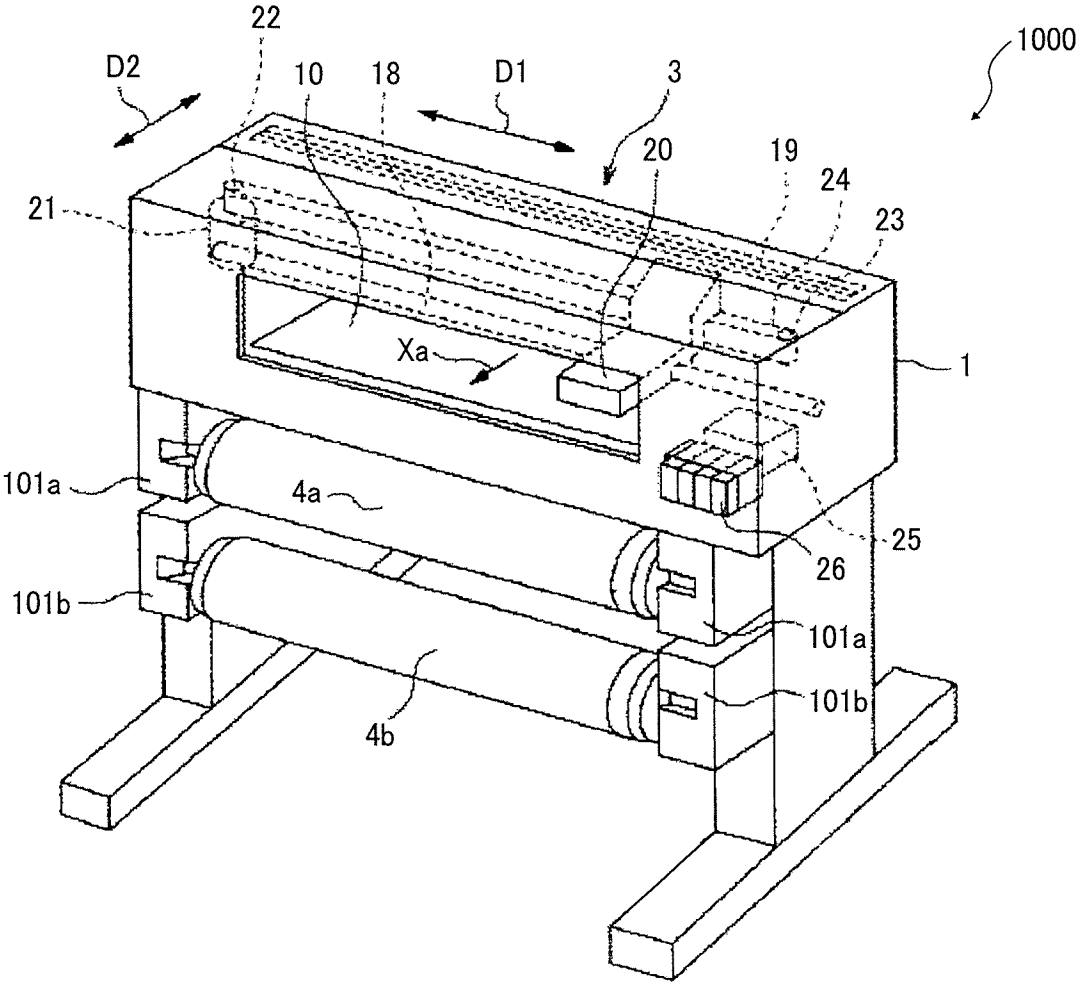
Figure 2:
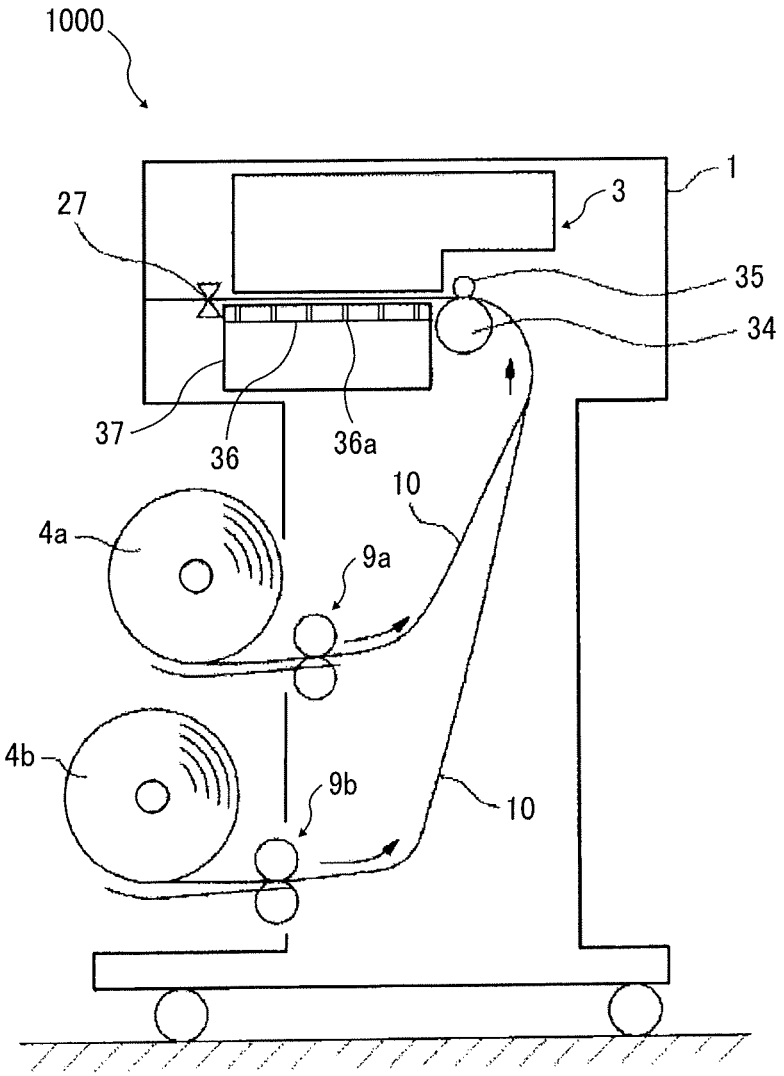
FIG. 2 is a cross-sectional view of an image forming apparatus.

Referring to FIGS. 1A and 1B, and FIG. 2, an example configuration and operation of an image forming apparatus according to an embodiment of the present disclosure is described below. The image forming apparatus is one example of a liquid discharge apparatus that discharges a liquid onto a medium such as a sheet of recording media.

FIG. 1A is a perspective view of the image forming apparatus 1000 according to the present embodiment. FIG. 1B is a perspective view of a maintenance unit 25 according to the present embodiment. FIG. 2 is a cross-sectional view of the image forming apparatus 1000 according to the present embodiment.

The image forming apparatus 1000 is an inkjet recording apparatus that includes an image forming section 3 to form an image on a recording medium with an inkjet method. As illustrated in FIGS. 1 and 2, the inkjet recording apparatus is a serial-type inkjet recording apparatus that moves the liquid discharge head during a recording process. However, the present embodiment is not limited to a serial-type inkjet recording apparatus and alternatively may be a line-type inkjet recording apparatus that does not move the liquid discharge head during the recording process.

The image forming apparatus 1000 in FIG. 1A includes spool bearing stands 101*a* and 101*b* inside an apparatus body 1. The spool bearing stands 101*a* and 101*b* function and are configured as a sheet roll support for supporting a sheet 10 of recording media (in this embodiment, a sheet of paper) feedable from a plurality of sheet paper rolls 4*a* and 4*b*, respectively. A continuous sheet of recording media is wound around each of the plurality of sheet paper rolls 4*a* and 4*b*. In the example illustrated in FIG. 1A, the image forming apparatus 1000 can mount two rolls of the sheet paper rolls 4*a* and 4*b*. However, the image forming apparatus 1000 may mount one or three or more rolls of the sheet paper rolls 4*a* and 4*b*.

The image forming section 3 includes a guide rod 18 and a guide rail 19 bridged between side plates in the apparatus body 1. The guide rod 18 and the guide rail 19 hold a carriage 20 to be slidably movable in a main scanning direction indicated by arrow D1. The image forming section 3 includes liquid discharge devices 201 each including a liquid discharge head 202 for discharging ink droplets of each color of black (K), yellow (Y), magenta (M), and cyan (C). The liquid discharge devices 201 are mounted on the carriage 20. Each of the liquid discharge devices 201 includes a sub tank 203 for supplying ink to the liquid discharge head 202. In the example described below, the "liquid discharge head" 202 is simply referred to as "head" 202.

The main scan moving unit that moves and scans the carriage 20 in the main scanning direction (D1 direction in FIG. 1A) includes a drive motor 21, a drive pulley 22, a driven pulley 23, and a belt member 24. The drive motor 21 is arranged on one side in the main scanning direction D1 (diagonally upward left in FIG. 1A). The drive pulley 22 is connected to an output shaft of the drive motor 21 and is rotated by the drive motor 21. The driven pulley 23 is disposed on the other side in the main scanning direction D1 (diagonally lower right in FIG. 1A). The belt member 24 is wound between the drive pulley 22 and the driven pulley 23. The driven pulley 23 is externally tensioned by a tension spring. That is, tension is applied to the driven pulley 23 in a direction away from the drive pulley 22. Further, a part of the belt member 24 is fixedly held by a belt fixing portion provided on a rear side of the carriage 20. Thus, the carriage 20 is pulled in the main scanning direction D1 by the belt member 24.

An encoder sheet for detecting a main scanning position of the carriage 20 is arranged along the main scanning direction D1 of the carriage 20. The encoder sheet is read by the encoder sensor 252 (see FIG. 7) provided on the carriage 20. In a main scanning area of the carriage 20, the sheet 10 delivered from the upper sheet paper roll 4*a* or the lower sheet paper roll 4*b* is conveyed by a conveyance device to a recording area. The conveyance device includes roller pairs 9*a* and 9*b*, a registration roller 34 that is a shaft member having a round bar shape, and a registration pressing roller 35 that includes a plurality of divided rollers arranged in an axial direction of the registration roller 34. As illustrated in FIGS. 1 and 2, the sheet 10 is intermittently conveyed in a front direction Xa of a sub-scanning direction D2 perpendicular to the main scanning direction D1 in which the carriage 20 moves. The front direction Xa is a front direction of the sub-scanning direction D2 indicated in FIG. 1A. The sheet 10 is guided to a position facing the carriage 20 by the platen 36. A suction fan 37 is provided below the platen 36, and the sheet 10 is sucked by suction holes 36*a* formed in the platen 36.

The image forming apparatus 1000 includes the maintenance unit 25 for maintaining the heads 202 mounted on the carriage 20. The maintenance unit 25 is disposed on one end region (in the present embodiment, the lower right corner in FIG. 1A) in the main scanning region Y.

As illustrated in FIG. 1B, the maintenance unit 25 includes a suction cap 31*a*, moisture retention caps 31*b*, a wiper 29, and a dummy discharge receptacle 28. The suction cap 31*a* and the moisture retention caps 31*b* cap a nozzle surface of the head 202 to prevent evaporation of moisture of ink in the head 202. The wiper 29 wipes the nozzle surface 202*a* of the head 202. The dummy discharge receptacle 28 receives liquid droplets when the image forming apparatus 1000 performs dummy discharge that discharges the liquid droplets that do not contribute to recording to discharge thickened ink. A nozzle suction device such as a suction pump 251 (see FIG. 7) is connected to the suction cap 31*a*. While the nozzle surface of the head 202 is capped by the suction cap, the suction pump 251 (see FIG. 7) is driven to remove the thickened ink adhered to a wall surface of the nozzle and adhered around a discharge opening of the nozzle. As described above, the suction cap 31*a* also functions as moisture retention and suction for preventing moisture evaporation of the ink in the head 202. At the same time, the moisture retention caps 31*b* is dedicated to the function of moisture retention.

Further, the image forming apparatus 1000 includes main cartridges 26 containing ink of each color to be supplied to the sub tanks 203 of the heads 202, respectively. The main cartridges are detachably attached to the apparatus body 1. As illustrated in FIG. 2, the image forming apparatus 1000 includes a cutter 27 serving as a sheet cutting device to cut a sheet, onto which an image is recorded by the image forming section 3, to a predetermined length. The cutter 27 is fixed to a wire or a timing belt wound around a plurality of pulleys (one of which is connected to a drive motor). The cutter 27 cuts the sheet 10 to a predetermined length by moving the wire or timing bet in the main scanning direction D1 by the drive motor.

Figure 3:
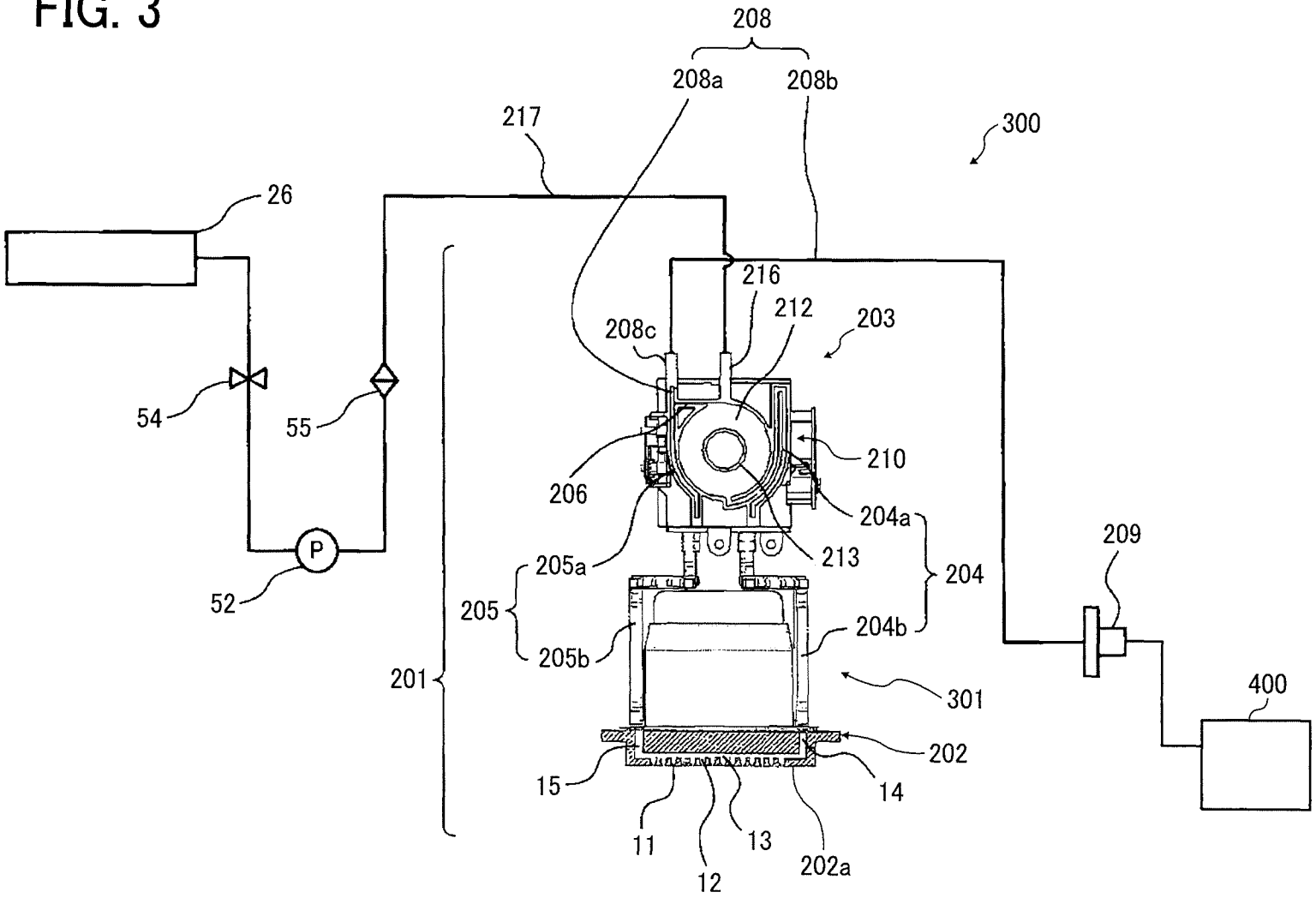
FIG. 3 is a schematic view of an ink channel.
Figure 4:
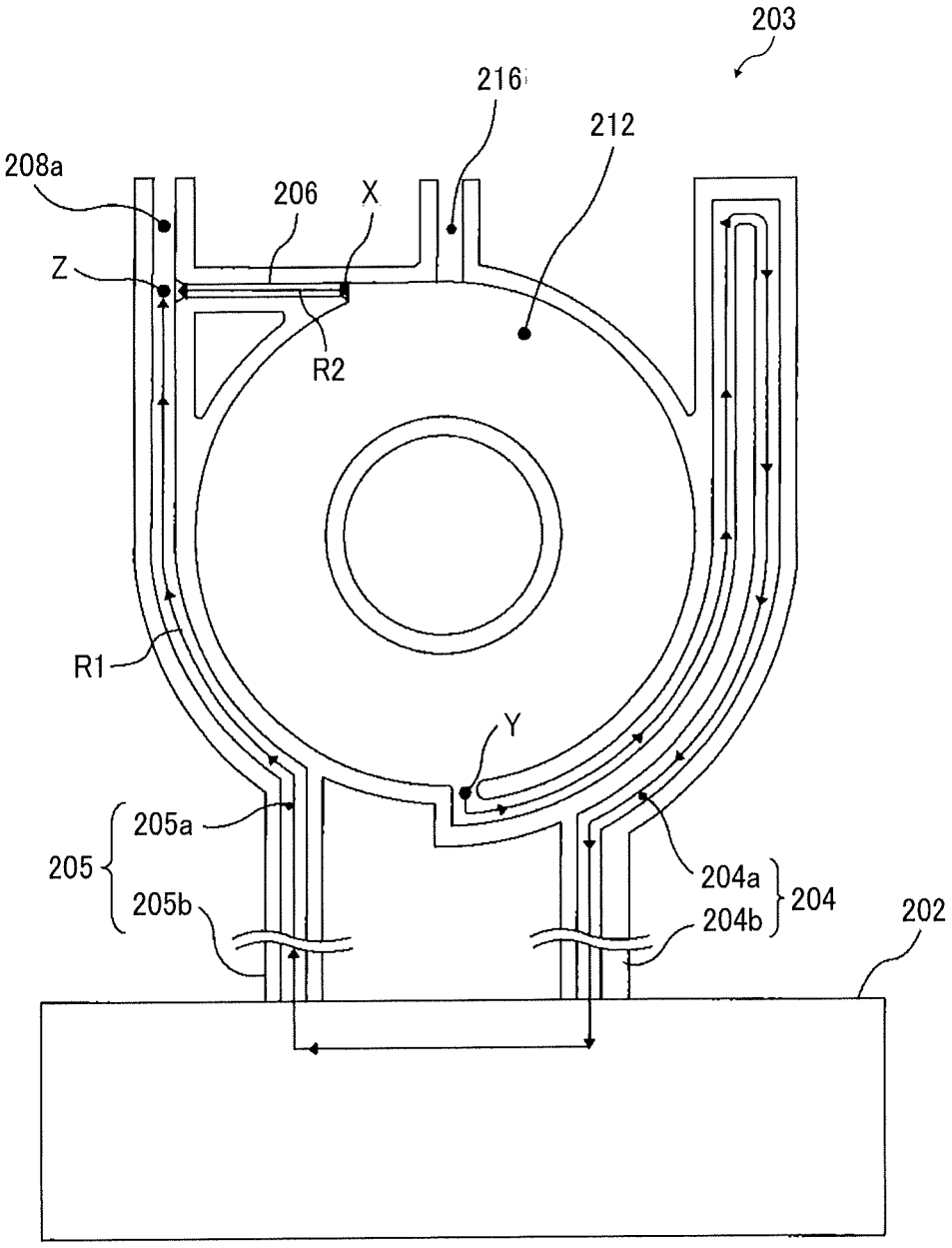
FIG. 4 is an enlarged view of a main part of an ink channel.

FIG. 3 is a schematic view of an ink channel 300. FIG. 4 is an enlarged view of a main part of the ink channel 300.

Figure 14:
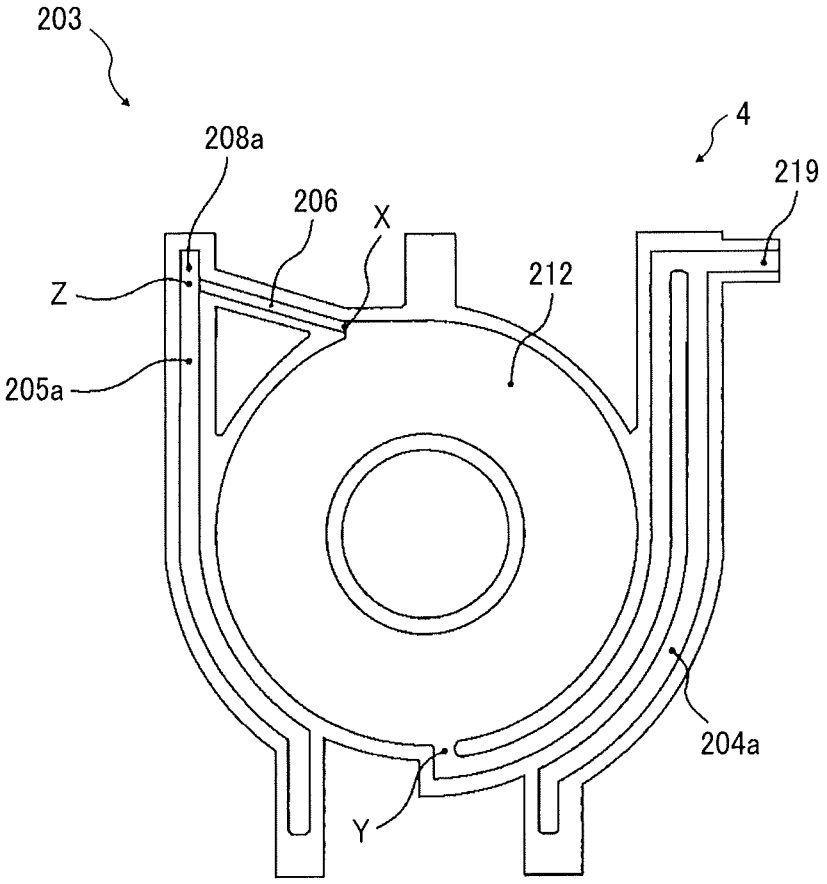
FIG. 14 is a cross-sectional view of a variation of the communication channel of the sub tank.
Figure 15:
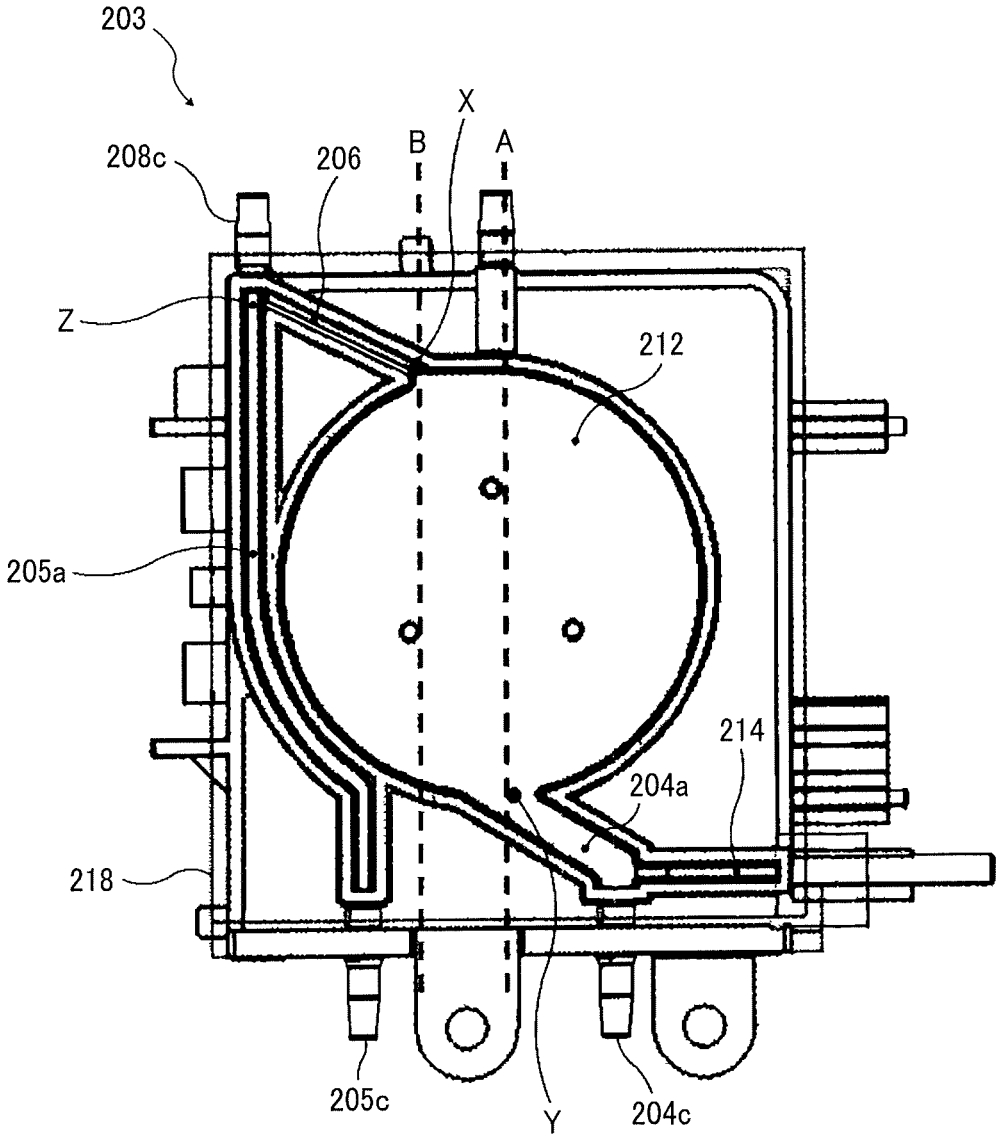
FIG. 15 is a cross-sectional view of a variation of the supply channel of the sub tank.
Figure 16:
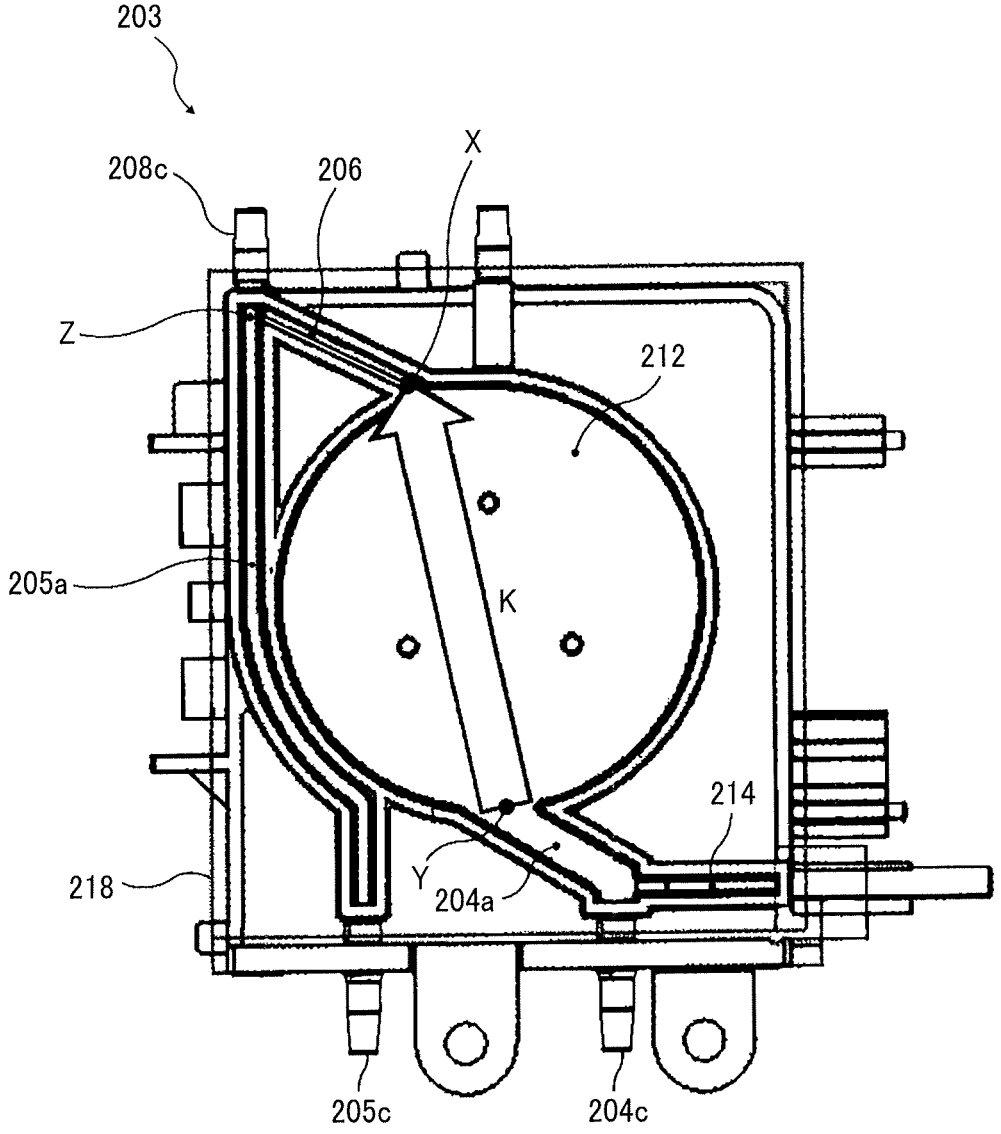
FIG. 16 is a cross-sectional view of the sub tank in the variation as illustrated in FIG. 15 to illustrate a movement of the air in the sub tank in FIG. 15.

The ink channel 300 illustrated in FIGS. 3 and 4 is provided to each of the heads 202. The configuration of the ink channel 300 for each of the heads is identical. The ink channel 300 includes a supply channel 217 and a discharge channel 208. The supply channel 217 supplies ink in the main cartridge 26 to an ink storage portion 212 of the sub tank 203. The discharge channel 208 discharges air in the ink channel 300 together with ink. The ink storage portion 212 is formed inside the sub tank 203 and serves as a liquid storage portion to store liquid (ink) in the sub tank 203. The ink channel 300 also includes a first channel 301 and a communication channel 206. The ink in the first channel 301 flows from the ink storage portion 212 to the discharge channel 208 via a common chamber 13 in the head 202 (see arrow R1 in FIG. 4). The communication channel 206 serves as a second channel. The ink in the communication channel 206 flows from the ink storage portion 212 to the discharge channel 208 without passing through the common chamber 13 of the head 202 (see arrow R2 in FIG. 4). The communication channel 206 is disposed substantially horizontally to connect a top portion of the ink storage portion 212 and the discharge channel 208. The communication channel 206 may be disposed diagonally upward from the top portion of the ink storage portion 212 toward the discharge channel 208 so that the air in the ink storage portion 212 can be smoothly discharged to the discharge channel 208 as illustrated in FIGS. 14 to 16.

In the present embodiment, the communication channel 206 is set to about 10 mm to 30 mm in length. The first channel 301 includes a head supply channel 204, the common chamber 13, and a head discharge channel 205. The head supply channel 204 extends from a junction Y (see FIG. 4) at a bottom of the ink storage portion 212 to the head 202 (to a connection portion with an ink supply port 14 of the head 202). The head discharge channel 205 extends from the head 202 (from a connection portion with an ink discharge port 15 of the head 202) to a junction Z of the communication channel 206 (to a connection portion of the discharge channel 208) in FIG. 4. As described below, the ink channel 300 is kept at negative pressure during a discharge operation that discharges ink from the head 202.

The liquid discharge device 201 includes the head 202 and the sub tank 203 that contains ink to be supplied to the head 202. The head 202 includes nozzles 11 to discharge ink droplets, individual chambers 12 communicating with the nozzles 11, respectively, the common chamber 13 to supply ink to the individual chambers 12, an ink supply port 14 serving as a supply port for supplying ink to the common chamber 13, an ink discharge port 15 serving as a discharge port to discharge ink from the common chamber 13, and the like.

The sub tank 203 includes the ink storage portion 212 and an ink supply channel 204*a*. The ink storage portion 212 accommodates ink to be supplied to the head 202. One end of the ink supply channel 204*a* is connected to a bottom portion (the junction Y in FIG. 4) of the ink storage portion 212. The other end of the ink supply channel 204*a* communicates to the exterior of the sub tank 203. The other end of the ink supply channel 204*a* is connected to one end of a supply tube 204*b*. The other end of the supply tube 204*b* is connected to the ink supply port 14 of the head 202. In the present embodiment, the ink supply channel 204*a* and the supply tube 204*b* form the head supply channel 204.

Further, the sub tank 203 includes a head discharge passage 205*a* through which the ink discharged from the head 202 flows. One end of the head discharge passage 205*a* is connected to an air vent channel 208*a* constituting a part of the discharge channel 208 (the junction Z in FIG. 4), and the other end of the head discharge passage 205*a* is connected a head discharge tube 205*b* connected to an ink discharge port 15 of the head 202. In the present embodiment, the head discharge passage 205*a* and the head discharge tube 205*b* form the head discharge channel 205.

The sub tank 203 includes the communication channel 206 serving as the second channel. One end of the communication channel is connected to the top portion of the ink storage portion 212 (junction X in FIG. 4). The other end of the communication channel 206 is connected to the air vent channel 208*a* (the junction Z in FIG. 4). The sub tank 203 includes an ink supply port 216 at the top portion of the ink storage portion 212. One end of a tube of the supply channel 217 is connected to the ink supply port 216.

The supply channel 217 is an ink channel from the main cartridge 26 to the ink supply port 216 of the sub tank 203. The main cartridge 26 is a replaceable main tank to supply ink to the ink storage portion 212 of the sub tank 203. The supply channel 217 includes a pump 52 to feed ink in the main cartridge 26 to the ink storage portion 212, a valve 54 to open and close a channel between the pump 52 and the main cartridge 26, a filter 55 disposed between the pump 52 and the ink storage portion 212, and tubes to connect the main cartridge 26, the valve 54, the pump 52, the filter 55, and the ink supply port 216 of the sub tank 203, for example.

The discharge channel 208 includes the air vent channel 208*a* and air discharge tube 208*b*. One end of the air discharge tube 208*b* is connected to the air vent channel 208*a*, and the other end of the air discharge tube 208*b* is connected to an air release valve 209. The air discharge tube 208*b* is composed of a tube or the like. The air vent channel 208*a* ranges from the junction Z, at which the head discharge passage 205*a* and the communication channel 206 join, to a portion at which one end of the air discharge tube 208*b* is connected. In the present embodiment, the air vent channel 208*a* and the air discharge tube 208*b* form the discharge channel 208.

In the present embodiment, a fluid resistance of a first channel 301 is less than a fluid resistance of the communication channel 206 serving as the second channel as indicated by arrow R2 in FIG. 4. The first channel 301 is formed by the head supply channel 204 indicated by arrow R1 in FIG. 4, the common chamber 13, and the head discharge channel 205. More specifically, the sum of a fluid resistance of the head supply channel 204 formed by the ink supply channel 204*a* and the supply tube 204*b*, a fluid resistance of the common chamber 13, and a fluid resistance of the head discharge channel 205 formed by the head discharge passage 205*a* and the head discharge tube 205*b* (a fluid resistance from the junction Y to the junction Z in FIG. 4) is smaller than a fluid resistance of the communication channel 206 (a fluid resistance from the junction X to the junction Z in FIG. 4).

Figure 5A:
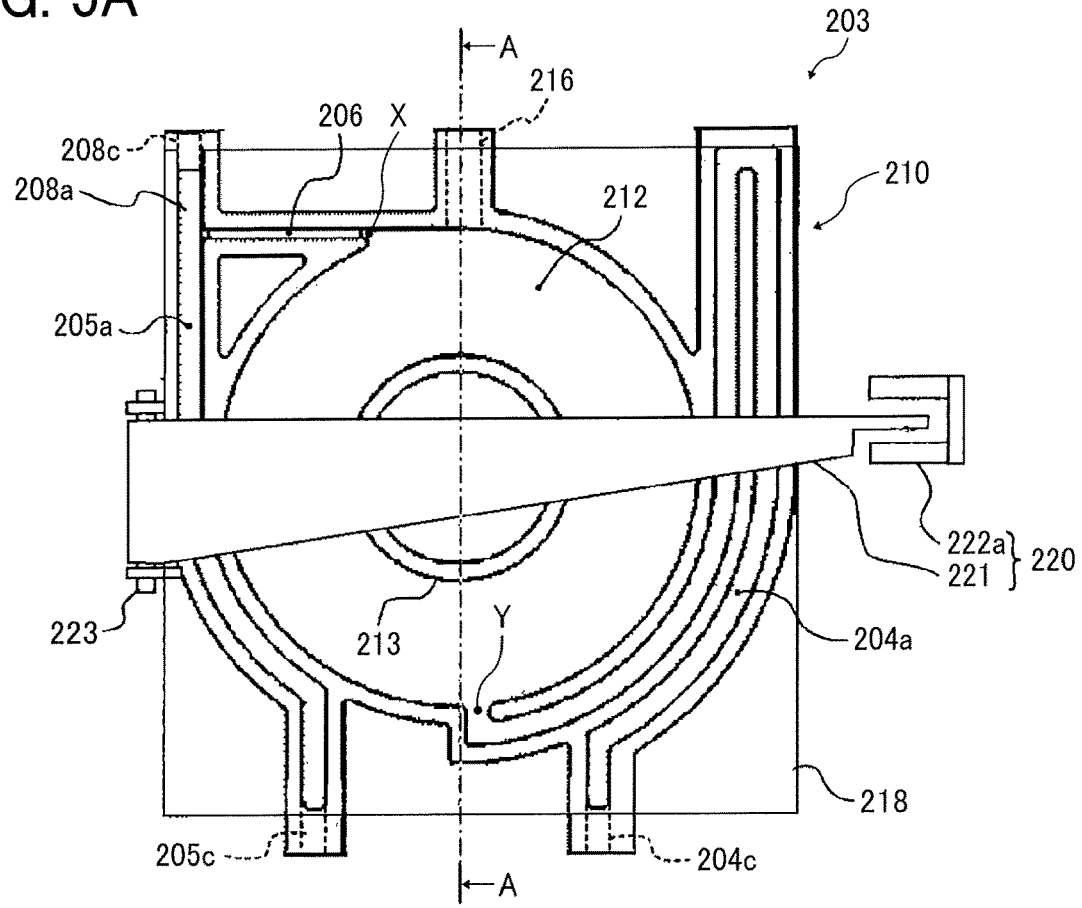
FIG. 5A is a schematic front view of a sub tank.
Figure 5B:
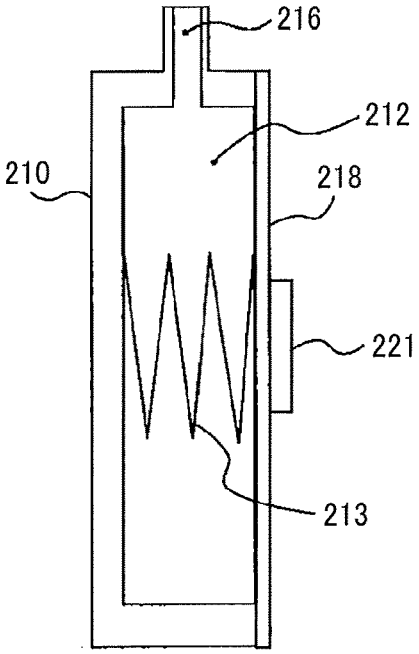
FIG. 5B is a cross-sectional view of the sub tank along a line A-A in FIG. 5A.

FIG. 5A is a schematic front view of the sub tank 203. FIG. 5B is a cross-sectional view of the sub tank along a line A-A in FIG. 5A.

The sub tank 203 includes a tank case 210 with one side opened, and a flexible film 218 as an elastically deformable member is attached to an opening of the tank case 210 by welding or adhesion.

The ink storage portion 212 and the communication channel 206 are formed by the flexible film 218 and the tank case 210. The sub tank 203 includes a supply connection portion 204*c* to which the supply tube 204*b* is connected. The supply connection portion 204*c* is disposed at the bottom end of the ink supply channel 204*a* in the sub tank 203. Except for the supply connection portion 204*c*, the head supply channel 204 of the sub tank 203 is formed by the flexible film 218 and the tank case 210. The supply connection portion 204*c* is formed by the tank case 210. Similarly, the sub tank 203 includes a discharge connection portion 205*c* to which the head discharge tube 205*b* is connected. The discharge connection portion 205*c* is disposed at the bottom end of the head discharge passage 205*a* in the sub tank 203. Except for the discharge connection portion 205*c*, the head discharge channel 205 of the sub tank 203 is formed by the flexible film 218 and the tank case 210. The discharge connection portion 205*c* is formed by the tank case 210.

Similarly, the sub tank 203 includes an air vent connection portion 208*c* to which the air discharge tube 208*b* is connected. The air vent connection portion 208*c* is disposed at the top end of the air vent channel 208*a* in the sub tank 203. Except for the air vent connection portion 208*c*, the discharge channel 208 of the sub tank 203 is formed by the flexible film 218 and the tank case 210. The air vent connection portion 208*c* is formed by the tank case 210. Further, the ink supply port 216 is formed by the tank case 210.

The sub tank 203 includes a spring 213 serving as a pressure controller. The spring 213 is disposed in the ink storage portion 212 to urge the flexible film 218 outward to maintain the ink channel 300 at a constant negative pressure. Further, the sub tank 203 includes a displacement detector 220 serving as a displacement detection unit for detecting the displacement of the flexible film 218. The displacement detector 220 includes a feeler 221, a first optical sensor 222*a*, and a second optical sensor 222*b*. One end (wider end) of the feeler 221 is rotatably supported a support shaft 223. The other end (leading end) of the feeler 221 displaces by rotating around the support shaft 223. The first optical sensor 222*a* and the second optical sensor 222*b* are arranged side by side in two rows in a direction along which the leading end the feeler 221 displaces (see FIGS. 6A to 6C). The direction of the displacement of the feeler 221 is along a direction perpendicular to a paper surface of FIG. 5A.

Figure 6A:
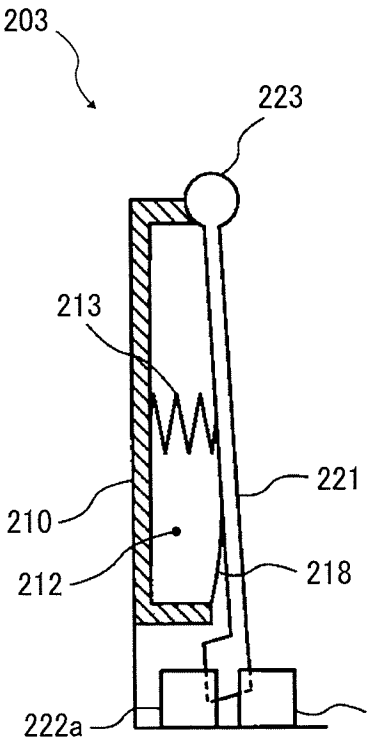
FIGS. 6A to 6C are top views of the sub tank and a displacement detector.
Figure 6B:
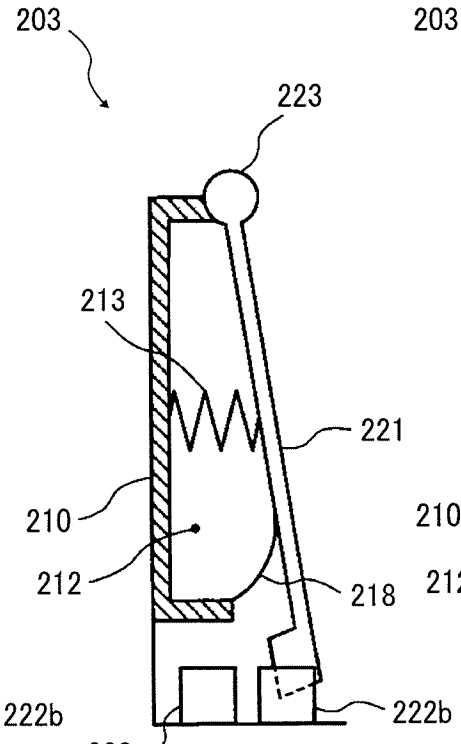
Figure 6C:
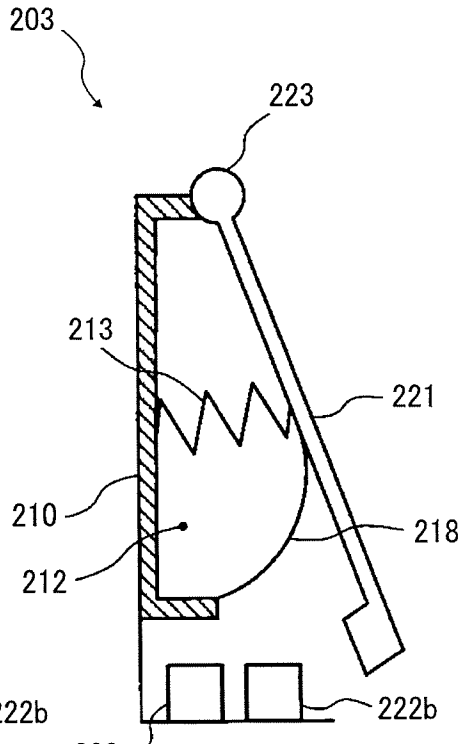

The first optical sensor 222*a* and the second optical sensor 222*b* are transmissive optical sensor (see FIGS. 6A to 6C for the second optical sensor 222*b*). The feeler 221 is pressed against the flexible film 218 by a spring weaker than an urging force of the spring 213. The feeler 221 constantly contacts the flexible film 218. Thus, the other end (leading end) of the feeler 221 is displaced according to a displacement of the flexible film 218. Further, a part of the feeler 221 may be fixed to the flexible film 218 by bonding or the like, and the leading end of the feeler 221 may be displaced in accordance with the displacement of the flexible film 218.

FIGS. 6A to 6C are top views of the sub tank 203 and the displacement detector 220. When a remaining amount of ink in the ink storage portion 212 is small as illustrated in FIG. 6A, the flexible film 218 positions closest to the tank case 210, and both of the first optical sensor 222*a* and the second optical sensor 222*b* detect the feeler 221. When both of the first optical sensor 222*a* and the second optical sensor 222*b* detect the feeler 221, the pump 52 is driven to supply ink from the main cartridge 26 to the ink storage portion 212 of the sub tank 203.

When ink is supplied to the ink storage portion 212 of the sub tank 203, the flexible film 218 is displaced outward (right hand side in FIG. 6A). Then, the feeler 221 rotates around the support shaft 223, and only the second optical sensor 222*b* detects the feeler 221 as illustrated in FIG. 6B. Further, when the flexible film 218 is further displaced outward by the urging force of the spring 213, both of the first optical sensor 222*a* and the second optical sensor 222*b* do not detect the feeler 221 as illustrated in FIG. 6C. When both of the first optical sensor 222*a* and the second optical sensor 222*b* do not detect the feeler 221, the controller 250 (see FIG. 7) stops driving the pump 52 and stops supplying ink from the main cartridge 26 to the ink storage portion 212 of the sub tank 203.

After supply ink from the main cartridge 26 to the ink storage portion 212 of the sub tank 203, negative pressure is created in the ink storage portion 212 (negative pressure forming operation). Specifically, the pump 52 is driven in a reverse direction to suck ink in the ink storage portion 212 to reduce an amount of ink in the ink storage portion 212. A dummy discharge operation may be performed to discharge ink in the ink storage portion 212 from the nozzles 11 of the head 202 without contributing to image formation (recording) to reduce the amount of ink in the ink storage portion 212. At this time, the air release valve 209 is closed, and the ink channel 300 illustrated in FIG. 3 is hermetically sealed.

Although the ink channel 300 communicates with the atmosphere via the nozzle 11, a diameter of the nozzle 11 is very small and the fluid resistance of the nozzle 11 is large. Thus, air does not enter the ink channel 300 from the nozzle 11. Therefore, the pressure in the ink channel 300 becomes negative and the flexible film 218 is displaced inward toward the tank case 210 as the amount of ink in the ink storage portion 212 is reduced. Then, as illustrated in FIG. 6B, if only the second optical sensor 222*b* detect the feeler 221, the pump 52 is driven to rotate reversely, or the dummy discharge operation is stopped. Thus, negative pressure can be created in the ink channel 300. Further, urging the flexible film 218 outward by the spring 213 can maintain the interior of the ink storage portion 212 at negative pressure.

When the head 202 continues to discharge ink in the ink storage portion 212 from the nozzles 11 along with image formation, the amount of ink in the ink storage portion 212 decreases, and the flexible film 218 is drawn inward to the tank case 210. When the sub tank 203 becomes the state as illustrated in FIG. 6A, ink is supplied to the ink storage portion 212 from the main cartridge 26 by the pump 52.

Figure 7:
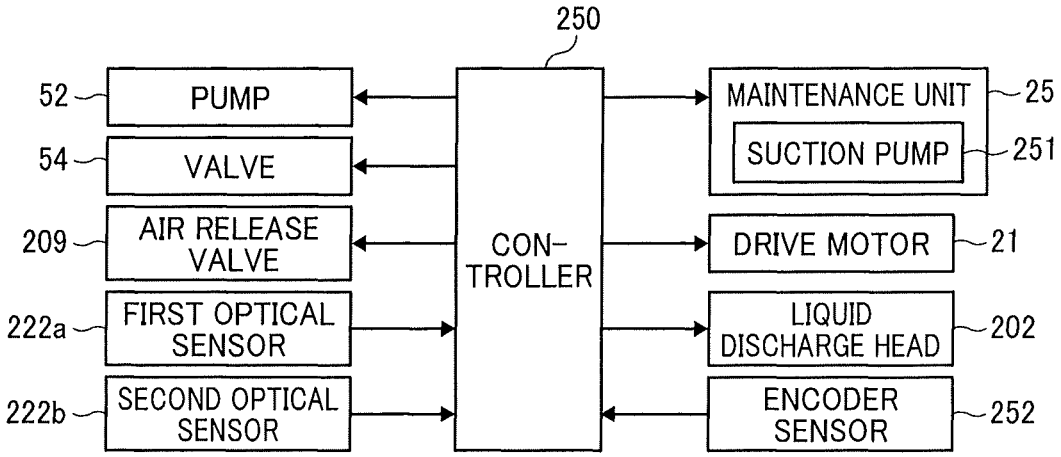
FIG. 7 is a block diagram of a main part of an electrical circuit of the image forming apparatus.

FIG. 7 is a block diagram of a main part of an electrical circuit of the image forming apparatus 1000.

The pump 52, the valve 54, the air release valve 209, the maintenance unit 25, the drive motor 21, the head 202, the first optical sensor 222*a*, the second optical sensor 222*b*, and the encoder sensor 252 are electrically connected to the controller 250. The controller 250 includes a central processing unit (CPU) for executing calculation processing and various programs, and a RAM for storing data.

Functions executed by the controller 250 may be implemented by one or more processing circuits or circuitry. Processing circuitry includes a programmed processor, as a processor includes circuitry. A processing circuit also includes devices such as the central processing unit (CPU), an application specific integrated circuit (ASIC), digital signal processor (DSP), field programmable gate array (FPGA), and conventional circuit components arranged to perform the recited functions.

The controller 250 controls the drive motor 21 based on readings from the encoder sensor 252 to control the movement of the carriage 20 in the main scanning direction D1. Further, the controller 250 controls the head 202 to control a discharge operation of ink from the nozzles 11. Further, the controller 250 controls the maintenance unit 25 to cap the nozzle surface 202*a* with the suction cap 31*a* and the moisture retention caps 31*b* or to remove ink from the nozzles 11 by the suction cap 31*a* and the suction pump 251.

Further, the controller 250 controls the pump 52 according to readings from the first optical sensor 222*a* and the second optical sensor 222*b* to control the supply of ink from the main cartridge 26 to the ink storage portion 212 of the sub tank 203. Thus, the controller 250 has a function of an ink supply unit. Further, the controller 250 controls the pump 52, the suction pump 251, and the like to perform an initial filling operation that fills the ink storage portion 212 and the head 202 with ink. Further, the controller 250 controls the air release valve 209, the pump 52, and the like to function as an air vent unit that removes air in the ink channel 300.

Next, an initial filling operation for filling ink I into the ink storage portion 212 and the head 202 is described below.

Figure 8:
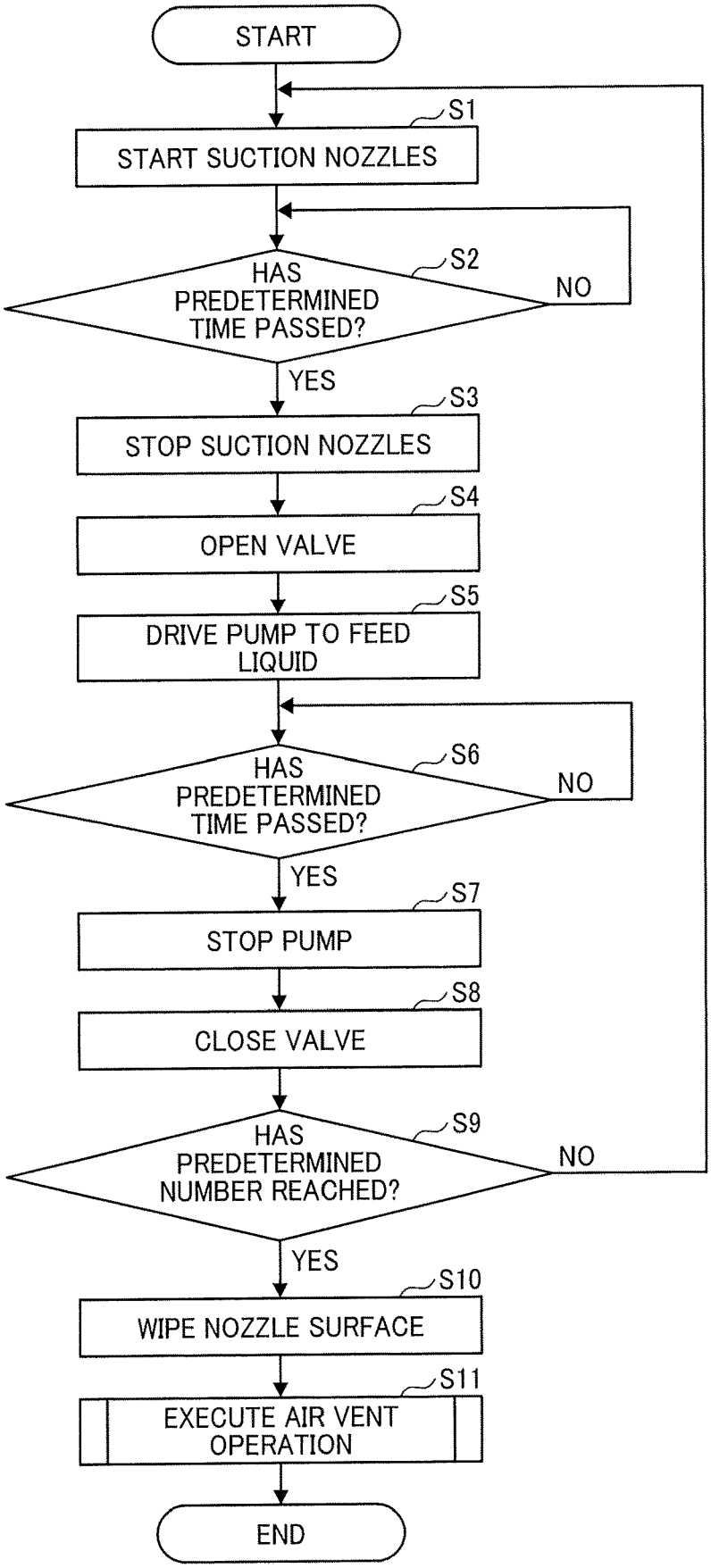
FIG. 8 is a flow chart of an initial filling operation.

FIG. 8 is a flow chart of the initial filling operation. FIGS. 9A to 9E are cross-sectional views of the sub tank 203 during the initial filling operation.

When the liquid discharge device 201 is exchanged, and execution of the initial filling operation is instructed by an operation of an operation display of the image forming apparatus, the controller 250 executes the initial filling operation. When the initial filling operation is executed, first, the controller 250 moves the carriage 20 to a position facing the maintenance unit 25 and caps the nozzle surface 202*a* of the head 202 with the suction cap 31*a* of the maintenance unit 25. Further, the controller 250 closes the air release valve 209 to seal the ink channel 300.

Next, the controller 250 drives the suction pump 251 serving as the nozzle suction device to suck the air in the liquid discharge device 201 from the nozzles 11 (S1). Further, when preservative solution is previously placed in the ink storage portion 212 or the head 202, the preservative solution is sucked by the suction cap 31*a* in instead of the air. When the air in the liquid discharge device 201 is sucked by the suction pump 251 for a predetermined time (Y in S2), a suction operation of the nozzles 11 is stopped (S3). Hereinafter, the "suction operation of the nozzles 11" is simply referred to as "nozzle suction".

In the present embodiment, the nozzle suction is stopped after the nozzle suction is executed for a predetermined time. However, the nozzle suction may be stopped based on the readings from the first optical sensor 222*a* and the second optical sensor 222*b*. Before the nozzle suction is executed by the suction pump 251, the ink channel 300 is at the same pressure as the atmosphere. The flexible film 218 is urged outward to the maximum position by the urging force of the spring 213. Thus, the sub tank 203 becomes the state as illustrated in FIG. 6C before the suction operation of the nozzles 11. A pressure inside the hermetically sealed ink channel 300 becomes negative by the nozzle suction. Thus, the sub tank 203 enters a state illustrated in FIG. 6A from a state illustrated in FIG. 6C, and the first optical sensor 222*a* and the second optical sensor 222*b* detect the feeler 221. When the first optical sensor 222*a* and the second optical sensor 222*b* detect the feeler 221, the nozzle suction is stopped.

When the nozzle suction is stopped, the controller 250 opens the valve 54 (S4), drives the pump 52, and feeds the ink in the main cartridge 26 to the ink storage portion 212 (S5). When a predetermined time has elapsed (Y in S6), the controller 250 stops driving the pump 52 (S7) and close the valve 54 (S8).

Figure 9A:
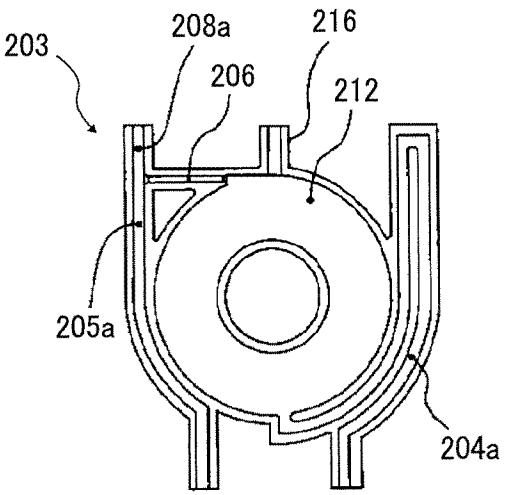
FIGS. 9A to 9E are cross-sectional views of the sub tank during the initial filling operation.
Figure 9B:
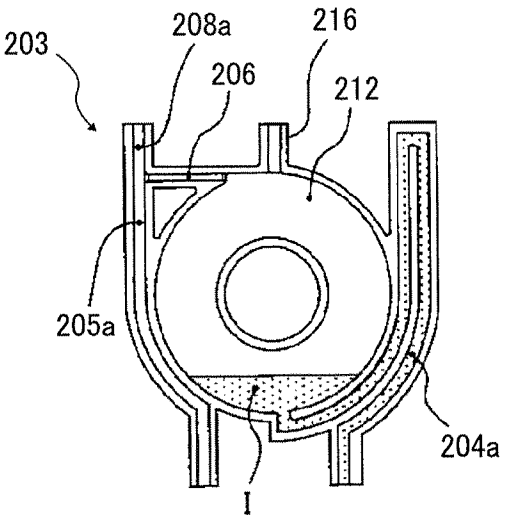

When the controller 250 starts driving the pump 52, the ink I is supplied from the ink supply port 216 to the empty ink storage portion 212 as illustrated in FIGS. 9A and 9B. When the ink I is supplied to the ink storage portion 212, the air in the head supply channel 204 is pushed out by the ink I and reaches the head 202. Then, a part of air is discharged from the nozzles 11 and reduces the negative pressure of the suction cap 31*a*. Further, a part of air flows to the head discharge channel 205 and reduces the negative pressure of the head discharge channel 205.

When the negative pressure in the head 202, the suction cap 31*a*, and the head discharge channel 205 is almost canceled, air cannot be pushed out by the supplied ink I. Thus, as illustrated in FIG. 9B, the ink I stops in the middle of the head supply channel 204. Further, when the negative pressure in the head 202, the suction cap 31*a*, and the head discharge channel 205 is almost canceled, ink cannot be supplied to the sub tank 203. The nozzles 11 are capped by the suction cap 31*a* and the air release valve 209 is closed so that the ink channel 300 is in a sealed states. Thus, ink I, an amount of which is equal to or more than a suction amount of the suction pump 251, cannot be supplied to the sub tank 203. Therefore, when the predetermined time has elapsed (Y in S6), the controller 250 stops driving the pump 52 (S7).

In the present embodiment, the controller 250 stops driving the pump 52 when a predetermined time has elapsed (Y in S6). However, the controller 250 may also stop driving the pump 52 based on the readings from the first optical sensor 222*a* and the second optical sensor 222*b*. When the suction pump 251 is stopped, the sub tank 203 is in the state as illustrated in FIG. 6A, and the first optical sensor 222*a* and the second optical sensor 222*b* detect the feeler 221. Then, when the controller 250 drives the pump 52 to supply ink to the sub tank 203, the flexible film 218 moves outward and finally reaches the state illustrated in FIG. 6C in which the first optical sensor 222*a* and the second optical sensor 222*b* do not detect the feeler 221. When the first optical sensor 222*a* and the second optical sensor 222*b* do not detect the feeler 221, the controller 250 stops driving the pump 52.

The controller 250 executes the nozzle suction by the suction pump 251 and then executes ink supply operations (S1 to S8) by the pump 52 for a predetermined number of times. The controller 250 executes the ink supply operation for a predetermined number of times. Thus, the air in the ink channel 300 decreases, and the ink channel 300 is filled with the ink I. Further, an execution of the nozzle suction by the suction pump 251 can supply the ink I to each of the individual chambers 12, can fill each individual chambers 12 with ink I, and can remove the air from each of the individual chambers.

When the head 202 is filled with ink I and the ink I reaches the head discharge channel 205, the ink I pushes the air in the head discharge channel 205 out of the head discharge channel 205. The air pushed out of the head discharge channel 205 flows through the communication channel 206 to the ink storage portion 212 to increase the pressure in the ink storage portion 212. As the pressure in the ink storage portion 212 is increased, the ink I in the ink storage portion 212 is pushed out to the head supply channel 204, flows to the head supply channel 204, and pushes up the surface of the ink I in the head discharge channel 205. Then, the air in the head discharge channel 205 flows through the communication channel 206 to the ink storage portion 212. With such a liquid flow, as illustrated in FIG. 9C, the liquid in the ink storage portion 212 and the liquid in the head discharge passage 205*a* reach the same height.

When the operations from S1 to S8 are executed for a predetermined number of times and the ink I is filled in the head 202, even if the nozzle suction is executed for a predetermined time by the suction pump 251, only ink I is discharged, air is not discharged, and an amount of ink I in the ink channel 300 does not increase. The predetermined number of times of execution of the operations from S1 to S8 can be previously obtained by experiment or the like. When the operations from S1 to S8 are executed for the predetermined number of times, only the ink I is discharged, and air is not discharged from the head 202 even if the nozzle suction is executed for a predetermined time by the suction pump 251.

Figure 9C:
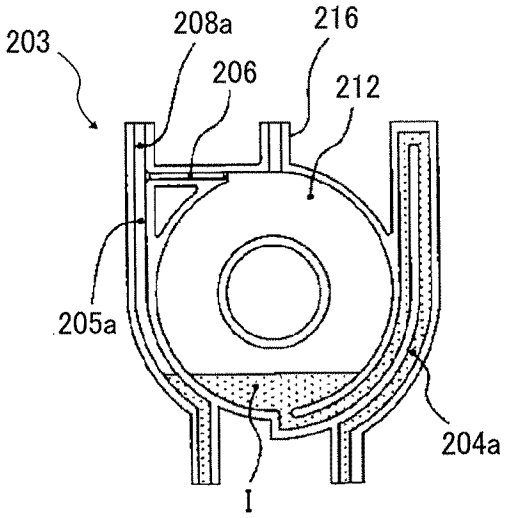

Further, a state in the ink channel 300 after the operations from S1 to S8 are executed for the predetermined number of times is not limited to a state as illustrated in FIG. 9C, and the state is different according to a configuration of an image forming apparatus. For example, according to the configuration of the image forming apparatus, only ink may be discharge from the head 202 even if the suction pump 251 performs the nozzle suction for a predetermined time before the head 202 is filled with the ink I.

As described above, when the operations from S1 to S8 are executed for the predetermined number of times and air cannot be discharged by the suction pump 251 (Y in S9), the controller 250 separates the suction cap 31*a* from the nozzle surface 202*a* of the head 202 and wipes the nozzle surface 202*a* with the wiper 29 of the maintenance unit 25 (S10). Then, the controller 250 executes an air vent operation as described below (S11).

The initial filling operation is executed for each of the liquid discharge devices 201 of colors of yellow Y), magenta (M), cyan (C), and black (K). Further, the operations from S1 to S9 in FIG. 8 may be executed for the liquid discharge device 201 of another color during execution of the air vent operation of the liquid discharge device 201 of one color.

Figure 9D:
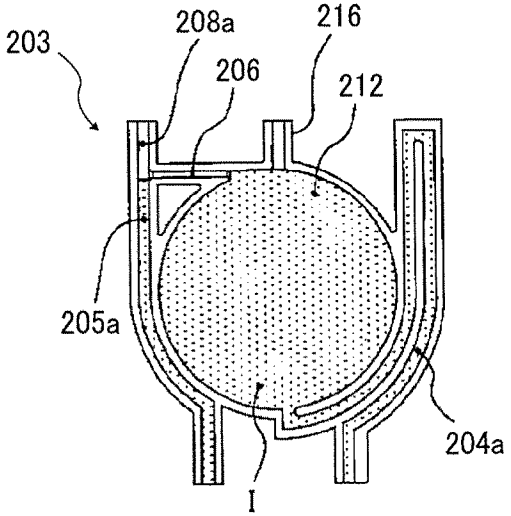
Figure 10:
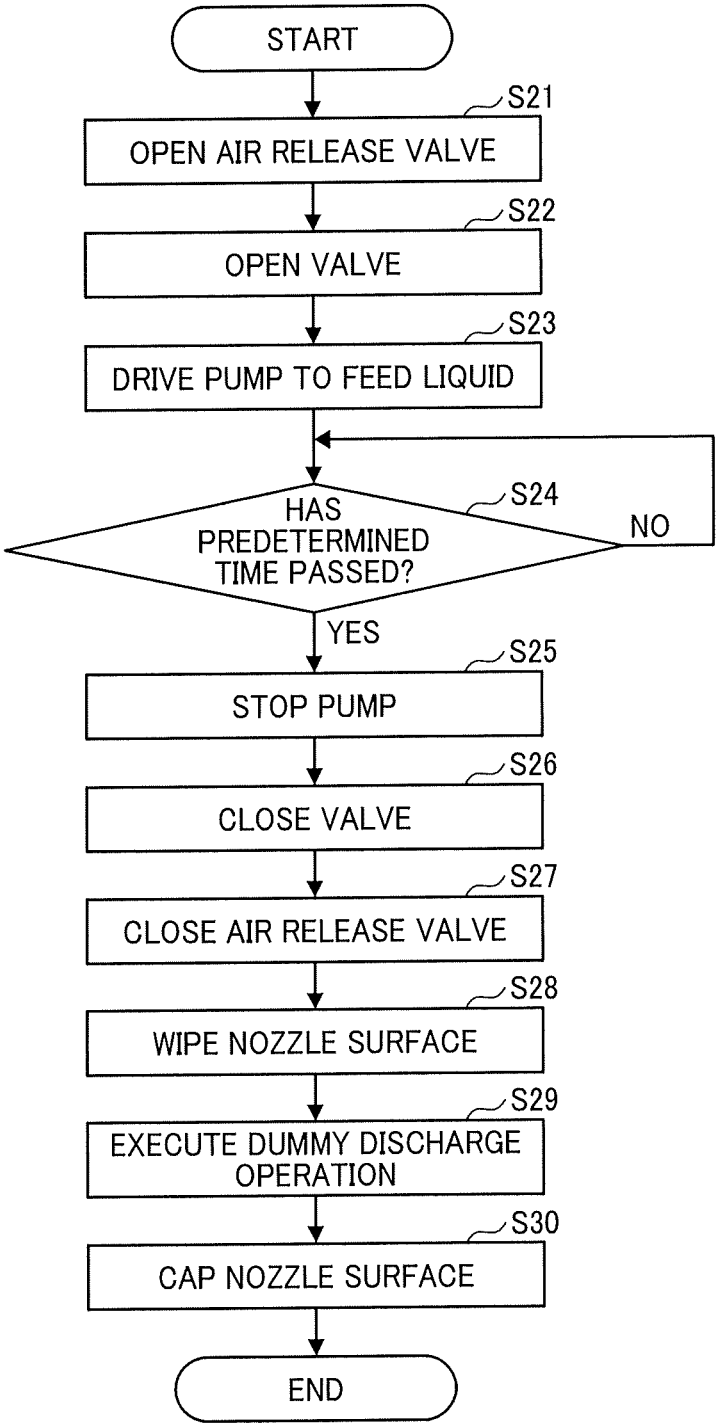
FIG. 10 is a flow chart of an air vent operation.

FIG. 10 is a flow chart of an air vent operation. First, the controller 250 opens the air release valve 209 to release the ink channel 300 to be communicated with the atmosphere (S21). Then, the controller 250 opens the valve 54 (S22) and drives the pump 52 to supply the ink I in the main cartridge 26 to the ink storage portion 212 (S23). Then, the air in the head discharge passage 205*a* flows to the discharge channel 208 and is discharged through the air release valve 209. Further, the air in the ink storage portion 212 flows through the communication channel 206 to the discharge channel 208 and is discharged outside the liquid discharge device 201 through the air release valve 209. Thus, as illustrated in FIG. 9D, the head discharge passage 205*a* and the ink storage portion 212 are filled with the ink I.

Figure 9E:
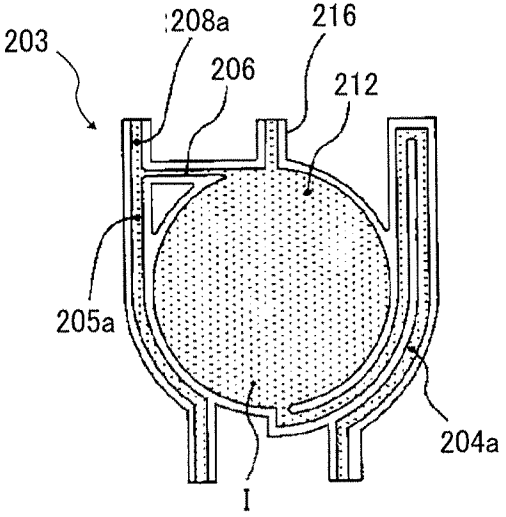

When the ink I is further supplied to the ink storage portion 212 from the state in FIG. 9D, the ink I flows through the communication channel 206 and finally flows to the discharge channel 208 as illustrated in FIG. 9E. In the present embodiment, the communication channel 206 is connected to the top portion of the ink storage portion 212. Thus, the air in the ink storage portion 212 can be discharged satisfactorily through the communication channel 206, and the ink I can be reliably filled in the ink storage portion 212.

In the present embodiment, a fluid resistance of a first channel 301 is less than a fluid resistance of the communication channel 206 serving as the second channel. The first channel 301 is formed by the head supply channel 204, the common chamber 13, and the head discharge channel 205. The fluid resistance of the first channel 301 is a fluid resistance from the junction Y to the junction Z in FIG. 4. The fluid resistance of the second channel is a fluid resistance from the junction X to the junction Z in FIG. 4.

Thus, as illustrated in 9E, the ink I supplied to the ink storage portion 212 hardly flows to the communication channel 206 and mainly flows to the first channel 301 (flow of arrow R1 in FIG. 4). Thus, the ink I hardly flows through the communication channel 206 as indicated by the arrow R2 in FIG. 4. Thus, the air remaining in the first channel 301 (the head supply channel 204, the common chamber 13, and the head discharge channel 205) can flow to the discharge channel 208 together with the flow of the ink I. Thus, the present embodiment can prevent the air from remaining in the first channel 301, prevent reduction of a degassing degree of the ink I, and prevent a discharge failure due to decrease in the degassing degree of the ink I.

Further, a fluid resistance of the first channel 301 (fluid resistance from the junction Y to the junction Z in FIG. 4) is preferably equal to or less than a half (½) of a fluid resistance of the communication channel 206. Accordingly, after the communication channel 206 is filled with the ink I, the ink I in the ink storage portion 212 can satisfactorily flow to the first channel 301.

When the controller 250 starts driving the pump 52, the controller 250 starts a timer and checks whether a predetermined time has elapsed (S24). When the predetermined time has elapsed (Y of S24), the controller 250 stops driving the pump 52 (S25) and closes the valve 54 (S26) to stop supplying the ink I to the sub tank 203. The ink I flows through the discharge channel 208 and is discharged from the air release valve 209, and the ink channel 300 is filled with ink during the predetermined time. Further, the controller 250 close the air release valve 209 (S27).

The ink I discharged from the air release valve 209 is stored in a waste liquid tank 400 set in the image forming apparatus 1000 (see FIG. 3). The waste liquid tank 400 may be provided in advance in the image forming apparatus 1000 or may be set in the image forming apparatus 1000 by an operator when executing the initial filling operation or the air vent operation.

In the present embodiment, predetermined time is previously obtained through experiments. The predetermined time is from time to start driving the pump 52 to time at which the ink I is discharged from the air release valve 209. The controller 250 stops driving the pump 52 after predetermined time has elapsed since the controller 250 starts driving the pump 52. However, the present embodiment is not limited to the embodiments as described above. For example, a sensor for detecting ink may be provided at a discharge portion of the air release valve 209. The controller 250 may stop driving the pump 52 when this sensor detects that the ink is discharged. Further, the controller 250 may stop driving the pump 52 when the operator determines that the ink is discharged to the waste liquid tank and operates the operation display to stop driving the pump 52.

After the controller 250 closes the air release valve 209 (S27), the controller 250 wipes the nozzle surface 202*a* by the wiper 29 of the maintenance unit 25 (S28). Then, the controller 250 executes the dummy discharge operation to reduce the pressure inside the ink channel 300 to negative pressure (S29). Then, the controller 250 caps the nozzle surface 202*a* of head 202 with the suction cap 31*a* and the moisture retention caps 31*b* (S30). Further, a capping operation of the step S30 may be executed for all of the liquid discharge devices 201 for colors of Y, M, C, and K when the air vent operation is completed.

Air may enter from a connecting portion between members constituting the ink channel 300 and accumulate in the ink channel 300 when the image forming apparatus 1000 has been left for a long time. The connection portion may be a connecting portion between the main cartridge 26 and a tube connected to the main cartridge 26. Further, air may enter the ink channel 300 when the main cartridge 26 is replaced. When air accumulates in the supply channel 217, the ink storage portion 212, the head supply channel 204, and the common chamber 13, for example, the ink, degassing degree of which is decreased, may be supplied to each of the individual chambers 12. Thus, the ink, the degassing degree of which is decreased, may influence discharging performance of the head 202. Therefore, the image forming apparatus 1000 preferably executes the air vent operation at predetermined times, such as when the image forming apparatus 1000 is left for a long time or when the main cartridge 26 is replaced, for example.

Figure 11:
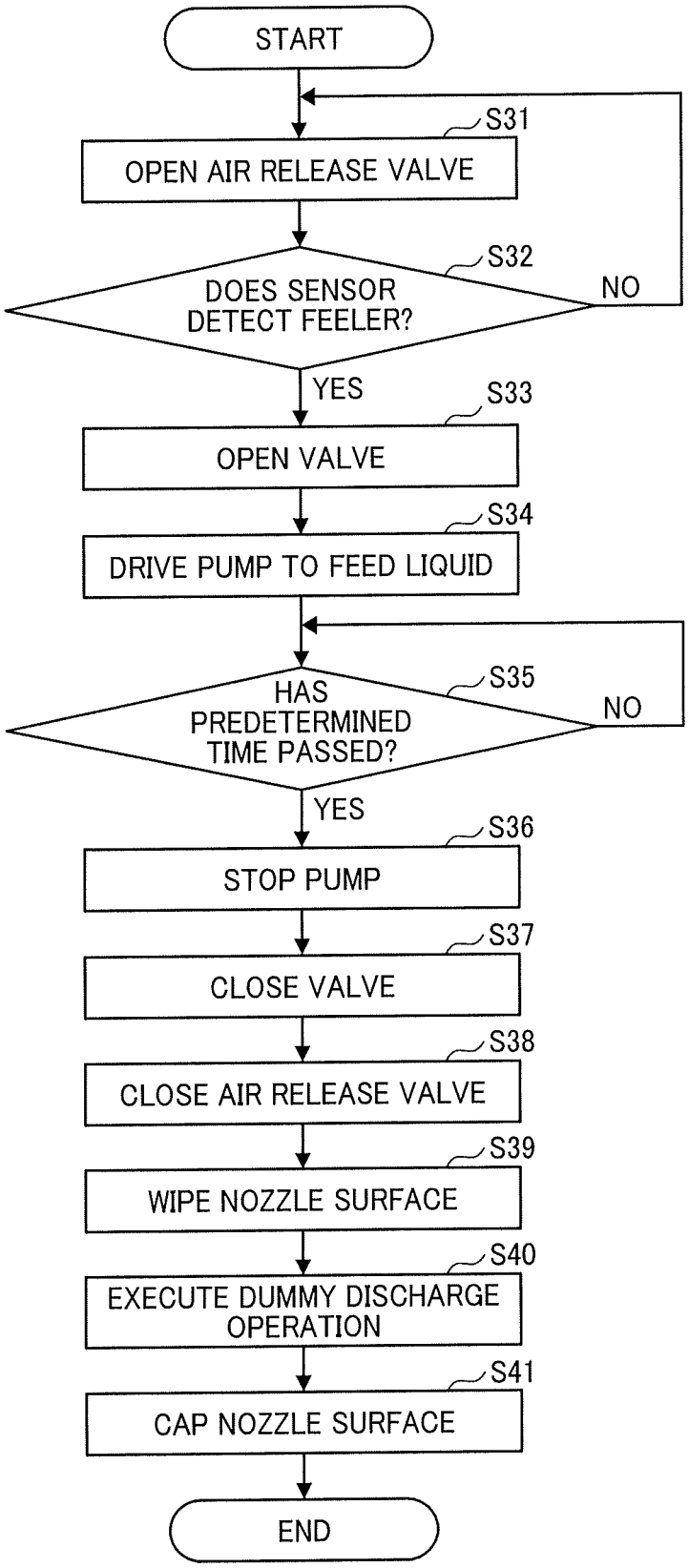
FIG. 11 is a flow chart of an example of the air vent operation executed at predetermined times.

FIG. 11 is a flow chart of an example of the air vent operation executed at predetermined times. First, the controller 250 opens the air release valve 209 (S31). As described above, the controller 250 executes the negative pressure forming operation after ink is supplied to the ink storage portion 212 so that the pressure in the ink channel 300 becomes negative. Therefore, the feeler 221 is at the position as illustrated in FIG. 6A and FIG. 6B, and at least the second optical sensor 222*b* detects the feeler 221. When the controller 250 opens the air release valve 209, the seal of the ink channel 300 is released, and air flows into the discharge channel 208 from the air release valve 209. Then, the ink I flows backward to the ink storage portion 212, the flexible film 218 moves outward, and the sub tank 203 enters a state as illustrated in FIG. 6C. Thus, the first optical sensors 222*a* and the second optical sensor 222*b* do not detect the feeler 221.

When neither the first optical sensor 222*a* nor the second optical sensor 222*b* detects the feeler 221 (Y in S32), the controller 250 opens the valve 54 (S33) and starts driving the pump 52 to start supply ink to the ink storage portion 212 (S34). Thus, the air accumulated in the ink channel 300 while the image forming apparatus 1000 is left for a long time can be discharged from the air release valve 209 together with the ink I. Further, a fluid resistance of the first channel 301 (fluid resistance from the junction Y to the junction Z in FIG. 4) is preferably equal to or less than a fluid resistance of the communication channel 206 (fluid resistance from the junction X to the junction Z in FIG. 4).

Thus, most of the ink supplied to the ink storage portion 212 flows to the head supply channel 204, the common chamber 13, and the head discharge channel 205. Thus, the air accumulated in the head supply channel 204 and the common chamber 13 can be discharged to the discharge channel 208 together with the flow of the ink I. Thus, the air accumulated in the supply channel 217, the ink storage portion 212, the head supply channel 204, the common chamber 13 and the ink I, the degassing degree of which is decreased, in the supply channel 217, the ink storage portion 212, the head supply channel 204, and the common chamber 13 can be satisfactorily discharged. Thus, the present embodiment can prevent the degassed ink from being supplied to the individual chamber 12 and thus can satisfactorily perform the discharge operation over time.

Further, the controller 250 of the present embodiment checks whether neither of the first optical sensor 222*a* nor the second optical sensor 222*b* detects the feeler 221 then supplies the ink to the ink storage portion 212. Thus, the present embodiment can obtain following effect. That is, the present embodiment can prevent the controller 250 to execute an ink supply operation when the air release valve 209 is not opened due to some trouble even if the controller 250 executes an operation of opening the air release valve 209. Thus, the present embodiment has an advantage such that the present embodiment can prevent a leakage of the ink I from the connecting portion between the sub tank 203 and the supply tube 204*b* and can prevent a breakage of the flexible film 218 adhered to the sub tank 203.

When the controller 250 drives the pump 52 for a predetermined time and sufficiently discharges the air accumulated in the ink channel 300 (Y in S35), the controller 250 stops driving the pump 52 (S36) and closes the valve 54 (S37) to stop supplying the ink to the sub tank 203. Next, after the controller 250 closes the air release valve 209 (S38), the controller 250 wipes the nozzle surface 202*a* with the wiper 29 of the maintenance unit 25 (S39) and executes the dummy discharge operation to reduce the pressure in the ink channel 300 to negative pressure (S40). Then, the controller 250 caps the nozzle surface 202*a* of the head 202 with the suction cap 31*a* and the moisture retention cap (S41).

Further, the present embodiment may detect the amount of air in the ink storage portion 212 and execute the air vent operation based on the readings from the amount of air.

Figure 12B:
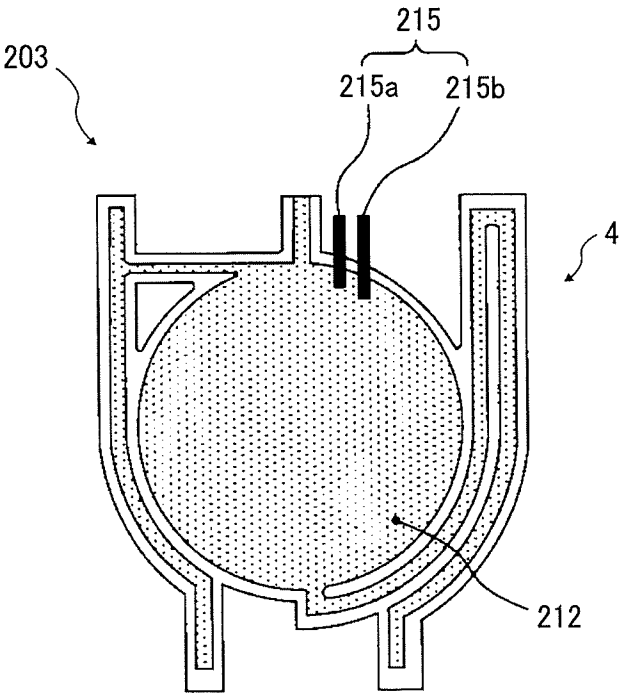
FIGS. 12A and 12B are cross-sectional views of the sub tank and an air detector to detect an amount of the air in the ink storage portion according to the embodiments.
Figure 12A:
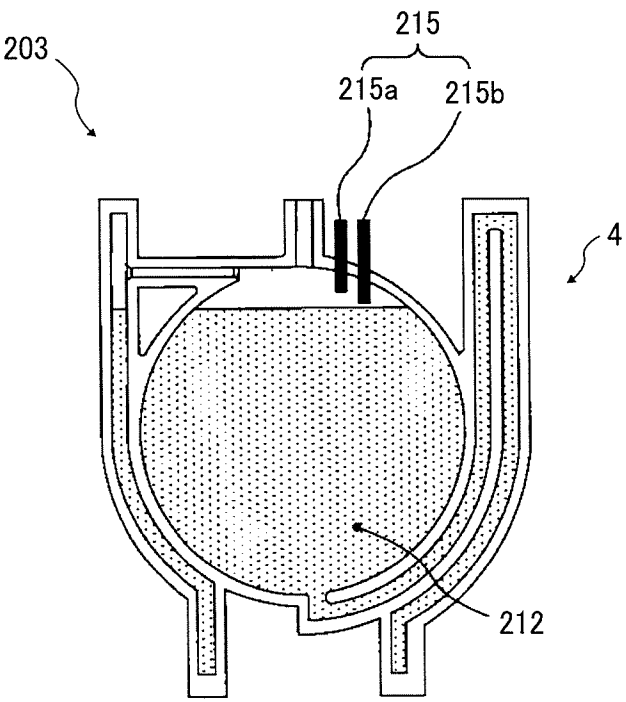

FIGS. 12A and 12B are cross-sectional views of the sub tank 203 and an air detector 215 according to the present embodiment. The air detector 215 detects an amount of air in the ink storage portion 212.

The air detector 215 includes two electrode pins 215*a* and 215*b*. As illustrated in FIG. 12B, when the electrode pins 215*a* and 215*b* contact the ink, current flows between the two electrode pins 215*a* and 215*b*. Conversely, as illustrated in FIG. 12A, when either one of the two electrode pins 215*a* or 215*b* is not in contact the ink, no current flows between the two electrode pins 215*a* and 215*b*. In this way, when the current is not flowing between the two electrode pins 215*a* and 215*b*, the controller 250 can detect and determine that there is a predetermined amount of air in the ink storage portion 212.

The length from the top portion of the ink storage portion 212 to the lower end of the electrode pins 215*a* and 215*b* may be appropriately determined based on the amount of air to be detected. Further, the present embodiment is not limited to the configuration as described above. For example, the sub tank 203 may include a float lighter than the ink. The controller 250 detects a vertical position of the float to detect the amount of air in the ink storage portion 212 of the sub tank 203. Further, although the sub tank 203 includes the air detector 215 in the ink storage portion 212, the sub tank 203 may include the air detector 215 at a position where the air is likely to accumulate in the sub tank 203.

Figure 13:
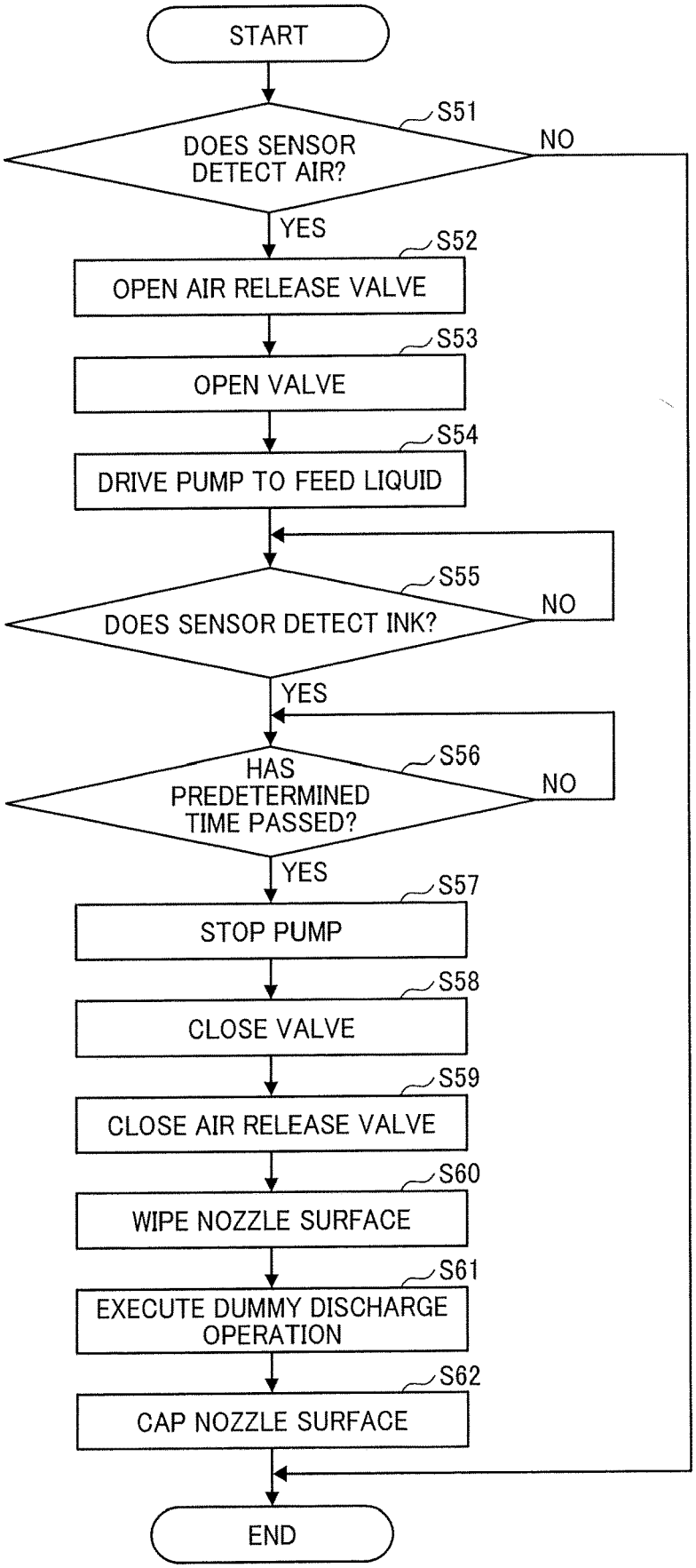
FIG. 13 is a flow chart of the air vent operation based on the readings from the air detector.

FIG. 13 is a flow chart of the air vent operation based on the readings from the air detector 215.

As illustrated in FIG. 13, when the air detector 215 detects that a predetermined amount of air is accumulated in the ink storage portion 212 (Y in S51), the controller 250 opens the air release valve 209 (S52) and opens the valve 54 (S53). Next, the controller 250 drives the pump 52 to start supplying ink I to the sub tank 203 (S54). When the ink storage portion 212 is filled with the ink I, current flows between the pair of electrode pins 215*a* and 215*b* of the air detector 215 (Y in S55). When the air detector 215 detects ink (Y in S55), the controller 250 starts measurement with a timer. When the timer has measured a predetermined time (Y in S56), the controller 250 stops driving the pump 52 (S57) and closes the valve 54 (S58) and the air release valve 209 (S59). Then, as similarly to the above described embodiments, the controller wipes the nozzle surface 202*a* with the wiper 29 (S60), executes the dummy discharge operation to reduce the pressure inside the ink storage portion 212 to negative pressure (S61), and caps the nozzle surface 202*a* with the suction cap 31*a* and the moisture retention caps 31*b* (S62).

When the air vent operation is executed at predetermined times such as after the image forming apparatus 1000 is left for a long time or after an elapse of a predetermined time, the controller 250 may executes the air vent operation even though air is not accumulated in the ink channel 300. Conversely, the present embodiment includes the air detector 215 and executes the air vent operation based on the readings from the air detector 215. Thus, the present embodiment can prevent unnecessary execution of the air vent operation and reduce a consumption of ink.

Further, when the controller 250 executes the air vent operation at predetermined times, the air vent operation is not executed until the predetermined time is reached even if a predetermined mount of air is accumulated. Thus, the degassing degree of the ink may be decreased until the predetermined time is reached. Conversely, the sub tank 203 includes the air detector 215, and the controller 250 executes the air vent operation based on the readings from the air detector 215. Thus, the controller 250 can execute the air vent operation at a stage when the predetermined amount of air is accumulated. Thus, the present embodiment can prevent a decrease in the degassing degree of the ink.

Further, the controller 250 controls supplying ink to the sub tank 203 according to the readings from the air detector 215 (according to a detection of ink by the air detector 215). Thus, the following advantages can be obtained. That is, in the air vent operation as illustrated in FIG. 11, when the amount of air accumulated in the ink channel 300 is large, air may not be discharged completely from the ink channel 300 even if the controller 250 drives the pump 52 for a predetermined time. Thus, air may remain in the ink channel 300. Further, if the controller 250 increases time of driving the pump 52 to reliably discharge the air accumulated in the ink channel 300, the amount of which is large, the liquid discharge device 201 may wastefully consume ink when the actual amount of air accumulated in the ink channel 300 is small. However, the controller 250 of the present embodiment controls supply ink to the sub tank 203 according to the readings from the air detector 215. Thus, the present embodiment can reduce an unnecessary consumption of ink and reliably discharges air from the ink channel 300.

FIG. 14 is a cross-sectional view of a variation of the communication channel 206 of the sub tank 203.

In the variation illustrated in FIG. 14, the communication channel 206 extends obliquely upward from the ink storage portion 212 and is connected to the air vent channel 208*a*. Thus, the ink flows through the communication channel 206 against the gravity force so that the ink hardly flows into the communication channel 206. Further, the communication channel 206 extending obliquely upward can increase an entrance loss of the communication channel 206 and makes it difficult for the ink to flow into the communication channel 206. Thus, a flow rate of the ink flowing through the first channel 301 including the communication channel 206 extending obliquely upward is greater than a flow rate of the ink flowing through the first channel 301 including the communication channel 206 extending in a horizontal direction. Thus, the communication channel 206 extending obliquely upward can reliably discharge air in the head supply channel 204 and the common chamber 13.

In FIG. 14, the sub tank 203 includes an air discharge channel 219 in a vicinity of the top portion of the ink supply channel 204*a*. The ink supply channel 204*a* extends vertically upward from the lower side of the ink storage portion 212. The air discharge channel 219 is normally closed and is opened to the atmosphere during the above-described air vent operation. The air (bubbles) entering into the ink supply channel 204*a* via the supply connection portion 204*c* is likely to accumulate near the top portion of the ink supply channel 204*a*. Therefore, the sub tank 203 including the air discharge channel 219 in the vicinity of the top portion can efficiently discharge the air remaining in the ink channel 300 during the above-described air vent operation.

FIG. 15 is a cross-sectional view of a variation of the ink supply channel 204*a* (corresponding to a part of the first channel 301) of the sub tank 203.

The ink supply channel 204*a* illustrated in FIG. 15 extends obliquely downward from a bottom portion (junction Y between the ink storage portion 212 and the ink supply channel 204*a*) of the ink storage portion 212 toward the supply connection portion 204*c*. The ink supply channel 204*a* extending obliquely downward can shorten a distance of the ink supply channel 204*a* as compared with the ink supply channel 204*a* that rises from the bottom portion of the ink storage portion 212 and folds back at a position above the top portion of the ink storage portion 212 and extends downward toward the supply tube 204*b* as illustrated in FIGS. 4 and 14. Further, the cross-sectional area of the ink supply channel 204*a* extending obliquely downward as illustrated in FIG. 15 is wider than the ink supply channel 204*a* extending vertically upward as illustrated in FIG. 4 and FIG. 14. Thus, the ink supply channel 204*a* as illustrated in FIG. 15 can prevent large bubbles or dust to enter and clog the ink supply channel 204*a*. Further, the present embodiment as illustrated in FIG. 15 can increase a fluid resistance of the first channel 301 to be greater than a fluid resistance of the communication channel 206 with a simple configuration.

Further, as illustrated in FIG. 15, the air discharge channel 214 for discharging air is disposed in a vicinity of the supply connection portion 204*c*. Even in this example in FIG. 15, the air discharge channel 214 disposed in the ink supply channel 204*a* can efficiently discharges air during execution of the air vent operation as compared with a configuration that includes only the discharge channel 208 as a channel that discharges bubbles.

In the example as illustrated in FIG. 15, the communication channel 206 has an inclined shape inclined obliquely upward from the ink storage portion 212 as similarly to FIG. 14. The ink supply channel 204*a* and the communication channel 206 are disposed to be substantially parallel to each other and inclined in the same direction. That is, the ink supply channel 204*a* is inclined such that a left end is positioned above a right end of the ink supply channel 204*a* in FIG. 16. Further, the communication channel 206 is inclined such that a left end is positioned above a right end of the communication channel 206 in FIG. 16. Further, a position of the junction X between the ink storage portion 212 and the communication channel 206 is slightly shifted to left side from a position of the junction Y between the ink storage portion 212 and the ink supply channel 204*a* as indicated by broken lines A and B in FIG. 15.

FIG. 16 is a cross-sectional view of the sub tank 203 in the variation as illustrated in FIG. 15. FIG. 16 illustrates a movement of the air discharged to the ink supply channel 204*a* in the sub tank 203 in FIG. 15.

The air may enter from the head 202 or a connection between the supply tube 204*b* and the supply connection portion 204*c* to the ink supply channel 204*a* through the supply connection portion 204*c*. The ink supply channel 204*a* has the same inclination with the inclination of the communication channel 206 such that both of the ink supply channel 204*a* and the communication channel 206 are inclined to be obliquely upward from the lower side of the ink supply channel 204*a* and the communication channel 206. Thus, the air smoothly floats through the ink supply channel 204*a* and the communication channel 206. Then, the air is discharged to the ink storage portion 212.

The air floating obliquely upward through the ink supply channel 204*a* and discharged to the ink storage portion 212 moves obliquely upward in the ink storage portion 212 toward the communication channel 206 with momentum that moves through the ink supply channel 204*a* as indicated by arrow K in FIG. 16. As a result, the air discharged from the ink supply channel 204*a* to the ink storage portion 212 is smoothly guided to the communication channel 206. The communication channel 206 is also inclined in the same direction as the inclination of the ink supply channel 204*a*. Thus, the air is guided to the communication channel 206 and smoothly moves to the communication channel 206. Then, the air moves through the communication channel 206 obliquely upward and is discharged to the air vent channel 208*a*.

In this way, the communication channel 206 and the ink supply channel 204*a* are inclined in the same direction. Further, the lower end of the communication channel 206

(junction X) is shifted to left side from the upper end of the ink supply channel 204*a* (junction Y) in a direction obliquely upward from the junction Y (right side) toward the junction X (left side) in FIG. 15. Thus, the air in the ink storage portion 212 can smoothly float and flow through the communication channel 206 and is discharged to the air vent channel 208*a* in the present embodiment. Thus, the present embodiment can prevent the ink in the ink supply channel 204*a* in the ink storage portions 212 to contact the air. Thus, the present embodiment can prevent a decrease in the degassing degree of the ink. Thus, the present embodiment can prevent the ink, the degassing degree of which is decreased, to be supplied to the head 202. Thus, the present embodiment can reduce an occurrence of discharge failure of the head 202.

In the present disclosure, the "liquid discharge head" refers to a functional part configured to discharge or eject liquid from a nozzle. Liquid to be discharged from the nozzle of the liquid discharge head is not limited to a particular liquid as long as the liquid has a viscosity or surface tension to be discharged from the liquid discharge head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The term "liquid discharge device" represents a structure including the liquid discharge head and a functional part(s) or mechanism combined to the liquid discharge head. That is, "liquid discharge device" is an assembly of parts relating to liquid discharge. For example, the "liquid discharge device" may include a combination of the liquid discharge head with at least one of a supply-circulation mechanism, a carriage, a maintenance unit, and a main scan moving unit.

Examples of the integrated unit include a combination in which the head and one or more functional parts and devices are secured to each other through, e.g., fastening, bonding, or engaging, and a combination in which one of the head and the functional parts and devices is movably held by another. Further, the head, the functional parts, and the mechanism may be configured to be detachable from each other.

Examples of the liquid discharge device further include a liquid discharge head integrated with a supply-circulation mechanism. In this case, the liquid discharge head and the supply-circulation mechanism may be connected to each other with a tube. Furthermore, a filter unit may be disposed between the supply-circulation mechanism and the liquid discharge head. The liquid discharge head and the carriage may form the "liquid discharge device" as a single unit. In still another example, the liquid discharge device includes the liquid discharge head movably held by a guide that forms part of a main scan moving unit, so that the head and the main scan moving unit form a single unit.

In still another example, the cap that forms part of the maintenance unit is secured to the carriage mounting the liquid discharge head so that the liquid discharge head, the carriage, and the maintenance unit form a single unit to form the liquid discharge device. Examples of the liquid discharge device further include a liquid discharge head integrated with a supply device in such a manner that a supply-circulation mechanism or a channel member is mounted on the liquid discharge head and a tube is connected to the liquid discharge head. Through this tube, the liquid in the liquid storage source such as an ink cartridge is supplied to the liquid discharge head. The main scan moving unit may be a guide only. The supply device may include only a tube(s) or a loading unit.

The term "liquid discharge apparatus" used herein is an apparatus including the liquid discharge head or the liquid discharge device to discharge liquid by driving the liquid discharge head. The liquid discharge apparatus may be, for example, an apparatus capable of discharging liquid to a material to which liquid can adhere and an apparatus to discharge liquid toward gas or into liquid. The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object. The "liquid discharge apparatus" is not limited to an apparatus to discharge liquid to visualize meaningful images, such as letters or figures. For example, the liquid discharge apparatus includes an apparatus to form meaningless images, such as meaningless patterns, or fabricate three-dimensional images.

The above-described term "material onto which liquid adheres" denotes, for example, a material or a medium onto which liquid is adhered at least temporarily, a material or a medium onto which liquid is adhered and fixed, or a material or a medium onto which liquid is adhered and into which the liquid permeates. Examples of the "material onto which liquid adheres" include recording media such as a paper sheet, recording paper, and a recording sheet of paper, film, and cloth, electronic components such as an electronic substrate and a piezoelectric element, and media such as a powder layer, an organ model, and a testing cell. The "material onto which liquid adheres" includes any material on which liquid adheres unless particularly limited. The above-mentioned "material onto which liquid adheres" may be any material as long as liquid can temporarily adhere such as paper, thread, fiber, cloth, leather, metal, plastic, glass, wood, ceramics, or the like.

Further, the term "liquid" includes any liquid having a viscosity or a surface tension that can be discharged from the liquid discharge head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The "liquid discharge apparatus" may be an apparatus to relatively move the liquid discharge head and a material on which liquid can be adhered. However, the liquid discharge apparatus is not limited to such an apparatus. For example, the "liquid discharge apparatus" may be a serial head apparatus that moves the liquid discharge head, a line head apparatus that does not move the liquid discharge head, or the like. Examples of the "liquid discharge apparatus" further include a treatment liquid coating apparatus to discharge the treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials. The terms "image formation", "recording", "printing", "image printing", and "fabricating" used herein may be used synonymously with each other.

The above-described embodiment is one example and, for example, the following aspects 1 to 10 of the present disclosure can provide the following advantages.

Aspect 1

A liquid discharge device (e.g., the liquid discharge device 201) includes a liquid discharge head (e.g., the liquid discharge head 202) to discharge a liquid, a liquid storage portion (e.g., the ink storage portion 212) to store the liquid, a first channel (e.g., the first channel 301) to discharge the liquid from the liquid storage portion (e.g., the ink storage portion 212) via the liquid discharge head, and a second channel (e.g., the communication channel 206) to connect a top portion of the liquid storage portion and the first channel. A fluid resistance of the first channel is less than a fluid resistance of the second channel. The first channel extends from a junction (e.g., the junction Y) between the liquid storage portion and the first channel to a junction (e.g., the junction Z) between the first channel and the second channel. The second channel extends from a junction (e.g., the junction X) between the liquid storage portion and the second channel to the junction (e.g., the junction Z) between the first channel and the second channel.

In a comparative example of a liquid discharge device, even if a fluid resistance of a communication channel as a second channel is made greater than a fluid resistance from a supply port to a discharge port, the fluid resistance of the first channel may become greater than the fluid resistance of the second channel according to a configuration from the discharge port to a junction with the communication channel. As a result, an amount of liquid flowing to the first channel may become less than an amount of liquid flowing to the second channel. Thus, air in the liquid discharge head may not be satisfactory discharged.

Conversely, in the aspect 1, since the fluid resistance of the entire first channel is made less than the fluid resistance of the second, an amount of liquid flowing to the first channel can be reliably made larger than an amount of liquid flowing to the second channel. Thus, air in the liquid discharge head can be satisfactory discharged.

Aspect 2

In the aspect 1, the second channel such as the communication channel 206 extends obliquely upward from a top portion of the liquid storage portion such as ink storage portion 212 (see FIGS. 14 and 15). According to the aspect 2, as illustrated in FIG. 14, the liquid such as ink is difficult to flow through the second channel as compared with the second channel extends in a horizontal direction. Thus, the sub tank (e.g., the sub tank 203) in the aspect 2 can increase the flow rate of the liquid flowing to the first channel as compared with the sub tank, the second channel of which extends in a horizontal direction (see FIG. 4). Thus, the aspect 2 can also flow the air remained in the first channel to a discharge channel (e.g., the discharge channel 208) together with the liquid.

Aspect 3

In the aspects 1 or 2, a direction of inclination of a part of the first channel is identical to a direction of inclination of the second channel. According to the aspect 3, as illustrated in FIG. 16, air discharged from the liquid discharge head to the first channel can be easily moved upward so that the air is easier to be discharged from the first channel.

Aspect 4

In the aspects 1 to 3, a fluid resistance of the first channel is equal to or less than half the fluid resistance of the second channel. According to the aspect 4, most of the liquid such as the liquid (e.g., the ink I) in the liquid storage portion can be flown into the first channel. Thus, the aspect 4 can reliably discharge the air remained in the liquid discharge head and the first channel together with the liquid flowing in the first channel.

Aspect 5

In the aspects 1 to 4, the liquid discharge head includes nozzles (e.g., the nozzles 11) to discharge the liquid, a plurality of individual chambers (e.g. the individual chambers 12) communicating with the nozzles, respectively, and a common chamber (e.g., common chamber 13) communicating each of the plurality of individual chambers and including a supply port (e.g., ink supply port 14) and a discharge port (e.g., ink discharge port 15). The first channel includes a head supply channel (e.g., the head supply channel 204), one end of which is connected the liquid storage portion and another end of which is connected to the supply port, the common chamber, an air vent channel (e.g., the air vent channel 208*a*) to discharge air in the liquid storage portion, and a head discharge channel (e.g., the head discharge channel 205), one end of which is connected to the ink discharge port and another end of which is connected to a junction (e.g., the junction Z) between the second channel and the air vent channel. A combined fluid resistance of the head supply channel, the common chamber, and the head discharge channel is less than a fluid resistance of the second channel.

According to the aspect 5, the fluid resistance of the first channel can be made less than the fluid resistance of the second channel such as the communication channel.

Aspect 6

A liquid discharge apparatus (e.g., the image forming apparatus 1000) includes the liquid discharge device according to any one of the aspects 1 to 5. According to the aspect 6, the liquid discharge apparatus can reduce the air remaining in the first channel, and thus can prevent a decrease in the degassing degree of the liquid in the first channel. Thus, the liquid discharge apparatus according to the aspect 6 can prevent the liquid having the decreased degassing degree from being discharged from the liquid discharge head, and thus can maintain a good discharge performance over time. Thus, the liquid discharge apparatus of the aspect 6 can obtain a good image over time.

Aspect 7

In the aspect 6, the liquid discharge apparatus further includes an air release valve (e.g., the air release valve 209) to discharge air in the liquid storage portion, a discharge channel (e.g., the discharge channel 208), one end of which is connected to the junction (e.g., the junction Z) between the first channel and the second channel and another end of which is connected to the air release valve, and circuitry (e.g., controller 250) to open the air release valve and supplies the liquid to the liquid storage portion to discharge air in the liquid storage portion from the air release valve.

The aspect 7 supplies the liquid to the liquid storage to flow the air remaining in the first channel to the discharge channel together with the liquid from the air release valve. Thus, the aspect 6 can fill an ink channel (e.g., the ink channel 300) with a liquid (e.g., ink I). Thus, the aspect 6 can prevent a decrease in the degassing degree of the liquid due to the air remained in the ink channel. Thus, the aspect 6 can maintain a stable discharge performance over time.

Aspect 8

In the aspect 7, the liquid discharge apparatus further includes a suction cap (e.g., the suction cap 31*a*) and a suction pump (e.g., the suction pump 251) to remove the liquid from the nozzles of the liquid discharge head. The circuitry executes a suction supply operation that sucks the ink from the nozzles of the liquid discharge head with the suction cap and the suction pump, supplies the liquid to the liquid storage portion, and discharges air in the liquid storage portion from the air release valve.

The aspect 8 executes the suction supply operation for a plurality of times to satisfactorily fill the individual chambers with liquid, and thus can remove the air from each individual chambers. Further, in the aspect 8, when the suction supply operation is executed for a plurality of times, the suction cap and the suction pump cannot suck air from the nozzles and only sucks the liquid.

Thus, in the aspect 8, the circuitry discharges air in the liquid storage portion air that cannot be removed by the suction supply operation from the air release valve after executing the suction supply operation for a plurality of times. The suction supply operation sucks the ink from the nozzles of the liquid discharge head with the suction cap and the suction pump and supplying the liquid to the liquid storage portion. Accordingly, the aspect 7 can fill the ink channel with the liquid and prevent a decrease in the degassing degree of the liquid.

Aspect 9

In the aspects 7 or 8, the liquid discharge apparatus further includes a displacement member (e.g., the flexible film 218) displaced according to a pressure in the liquid storage portion and a displacement detector (e.g., the displacement detector 220) to detect a displacement of the displacement member. The circuitry supplies the liquid to the liquid storage portion according to readings from the displacement detector.

The aspect 9 as illustrated in FIG. 11 can prevent the ink to be supplied to the liquid storage portion when the air release valve does not open even if the circuitry controls to open the air release valve due to some trouble. Thus, the aspect 9 can prevent the liquid from leaking from the connecting portion between the members in the ink channel.

Aspect 10

In any one of the aspects 7 to 9, the liquid discharge apparatus in the aspect 10 further includes an air detector (e.g., the air detector 215) to detect an amount of air in the liquid storage portion and the circuitry to discharge air in the liquid storage portion from the air release valve according to readings from the air detector.

The aspect 10 as illustrated in FIG. 13 can remove air from the ink channel when the air accumulates in the ink channel. Further, the aspect 10 can reduce wasteful consumption of the liquid and prevent the decrease in the degassing degree of the liquid compared with a liquid discharge apparatus that periodically discharges air.

Any one of the above-described operations may be performed in various other ways, for example, in an order different from the one described above. The methods described above can be provided as program codes stored in a recording medium, to cause a processor to execute the method when executed by at least one processor.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge device, comprising:

a liquid discharge head configured to discharge a liquid;

a liquid storage portion configured to store the liquid;

a first channel configured to discharge the liquid from the liquid storage portion via the liquid discharge head; and a second channel configured to connect a top portion of the liquid storage portion and the first channel, the first channel extending from a first junction between the liquid storage portion and the first channel to a second junction between the first channel and the second channel, the second channel extending from a third junction between the liquid storage portion and the second channel to the second junction between the first channel and the second channel, and a fluid resistance of the first channel being less than a fluid resistance of the second channel so that a first amount of the liquid flowing through the first channel is larger than a second amount of the liquid flowing through the second channel.

2. The liquid discharge device according to claim 1, wherein the second channel extends obliquely upward from the top portion of the liquid storage portion.

3. The liquid discharge device according to claim 1, wherein an angle of inclination of a part of the first channel is identical to an angle of inclination of the second channel.

4. The liquid discharge device according to claim 1, wherein the fluid resistance of the first channel is equal to or less than half the fluid resistance of the second channel.

5. The liquid discharge device according to claim 1, wherein the liquid discharge head includes:

nozzles configured to discharge the liquid;

a plurality of individual chambers communicating with the nozzles, respectively; and a common chamber communicating with each of the plurality of individual chambers and including a supply port and a discharge port, the first channel includes:

a supply channel, one end of which is connected to the liquid storage portion and another end of which is connected to the supply port;

the common chamber;

an air vent channel configured to discharge air in the liquid storage portion; and a head discharge channel, one end of which is connected to the discharge port and another end of which is connected to a junction between the second channel and the air vent channel, and a combined fluid resistance of the supply channel, the common chamber, and the head discharge channel is less than the fluid resistance of the second channel.

6. A liquid discharge apparatus comprising the liquid discharge device according to claim 5.

7. The liquid discharge apparatus according to claim 6, further comprising:

an air release valve to discharge air in the liquid storage portion;

a discharge channel, one end of which is connected to the junction between the first channel and the second channel and another end of which is connected to the air release valve; and circuitry configured to open the air release valve and supply the liquid to the liquid storage portion to discharge air in the liquid storage portion from the air release valve.

8. The liquid discharge apparatus according to claim 7, further comprising a suction cap and a suction pump to remove the liquid from the nozzles of the liquid discharge head, wherein the circuitry is further configured to discharge the air in the liquid storage portion from the air release valve after executing a suction supply operation for a plurality of times, the suction supply operation sucking the liquid from the nozzles of the liquid discharge head with the suction cap and the suction pump and supplying the liquid to the liquid storage portion.

9. The liquid discharge apparatus according to claim 7, further comprising:

a displacement member to be displaced according to a pressure in the liquid storage portion; and a displacement detector configured to detect a displacement of the displacement member, wherein the circuitry is further configured to supply the liquid to the liquid storage portion according to readings from the displacement detector.

10. The liquid discharge apparatus according to claim 7, further comprising an air detector configured to detect an amount of air in the liquid storage portion, wherein the circuitry is further configured to discharge air in the liquid storage portion from the air release valve according to readings from the air detector.

11. A liquid discharge apparatus comprising the liquid discharge device according to claim 1.

12. A liquid discharge device, comprising:

a liquid discharge head configured to discharge a liquid;

a liquid storage portion configured to store the liquid;

a first channel configured to discharge the liquid from the liquid storage portion via the liquid discharge head; and a second channel configured to connect a top portion of the liquid storage portion and the first channel, wherein the first channel extends from a first junction between the liquid storage portion and the first channel to a second junction between the first channel and the second channel, the second channel extends from a third junction between the liquid storage portion and the second channel to the second junction between the first channel and the second channel, a fluid resistance of the first channel is less than a fluid resistance of the second channel, and an angle of inclination of a part of the first channel is identical to an angle of inclination of the second channel.

13. A liquid discharge device, comprising:

a liquid discharge head configured to discharge a liquid, the liquid discharge head including a common chamber including a supply port and a discharge port;

a liquid storage portion configured to store the liquid;

a first channel configured to discharge the liquid from the liquid storage portion via the liquid discharge head; and a second channel configured to connect a top portion of the liquid storage portion and the first channel, wherein the first channel extends from a first junction between the liquid storage portion and the first channel to a second junction between the first channel and the second channel, the second channel extends from a third junction between the liquid storage portion and the second channel to the second junction between the first channel and the second channel, a fluid resistance of the first channel is less than a fluid resistance of the second channel, the first channel includes:

a supply channel, one end of which is connected to the liquid storage portion and another end of which is connected to the supply port;

an air vent channel configured to discharge air in the liquid storage portion; and a head discharge channel, one end of which is connected to the discharge port and another end of which is connected to a junction between the second channel and the air vent channel, and a combined fluid resistance of the supply channel, the common chamber, and the head discharge channel is less than the fluid resistance of the second channel.

* * * * *